US010639886B2

(12) United States Patent
Maehira

(10) Patent No.: US 10,639,886 B2
(45) Date of Patent: May 5, 2020

(54) CONTROL DEVICE, NON-TRANSITORY COMPUTER-READABLE MEDIUM, CONTROL METHOD

(71) Applicant: BROTHER KOGYO KABUSHIKI KAISHA, Nagoya-shi, Aichi-ken (JP)

(72) Inventor: Hirotoshi Maehira, Nagoya (JP)

(73) Assignee: BROTHER KOGYO KABUSHIKI KAISHA, Nagoya-Shi, Aichi-Ken (JP)

( * ) Notice: Subject to any disclaimer, the term of this patent is extended or adjusted under 35 U.S.C. 154(b) by 0 days.

(21) Appl. No.: 16/296,958

(22) Filed: Mar. 8, 2019

(65) Prior Publication Data

US 2019/0299603 A1 Oct. 3, 2019

(30) Foreign Application Priority Data

Mar. 27, 2018 (JP) ..... 2018-059630

(51) Int. Cl.
*B41J 2/045* (2006.01)
*B41J 13/00* (2006.01)

(52) U.S. Cl.
CPC ..... *B41J 2/04573* (2013.01); *B41J 2/04586* (2013.01); *B41J 13/0009* (2013.01)

(58) Field of Classification Search
CPC ..... B41J 2/04573; B41J 2/04586; B41J 13/0009; B41J 13/0027
See application file for complete search history.

(56) References Cited

U.S. PATENT DOCUMENTS 6,364,446 B1 * 4/2002 Ishikawa ..... G06K 15/107 347/15
2015/0254538 A1 9/2015 Fukazawa et al.
2016/0243862 A1 8/2016 Yoshida
2016/0288527 A1 * 10/2016 Hasegawa ..... H04N 1/6036
2017/0151816 A1 * 6/2017 Yoshida ..... B41J 13/0009
2017/0282591 A1 * 10/2017 Ozawa ..... B41J 2/2132

FOREIGN PATENT DOCUMENTS

JP 2015-168086 A 9/2015
JP 2016-153182 A 8/2016

* cited by examiner

*Primary Examiner* — Sharon A. Polk
(74) *Attorney, Agent, or Firm* — Merchant & Gould P.C.

(57) ABSTRACT

A control device that controls a printing execution unit to execute printing by alternately executing partial printings, which forms the dot using the print head, and print medium conveying, which conveys the print medium using the conveyor, the conveyor including: a first roller; a second roller; and a third roller, wherein a first holding state is a state where the print medium is held by the first roller, is held by the second roller, and is held by the third roller, a second holding state is a state where the print medium is held by the first roller, is held by the second roller, and is not held by the third roller, and a length of the second partial image printed in the first holding state is longer than a length of the second partial image printed in the second holding state.

18 Claims, 12 Drawing Sheets

FIG. 4A INITIAL HOLDING STATE S0
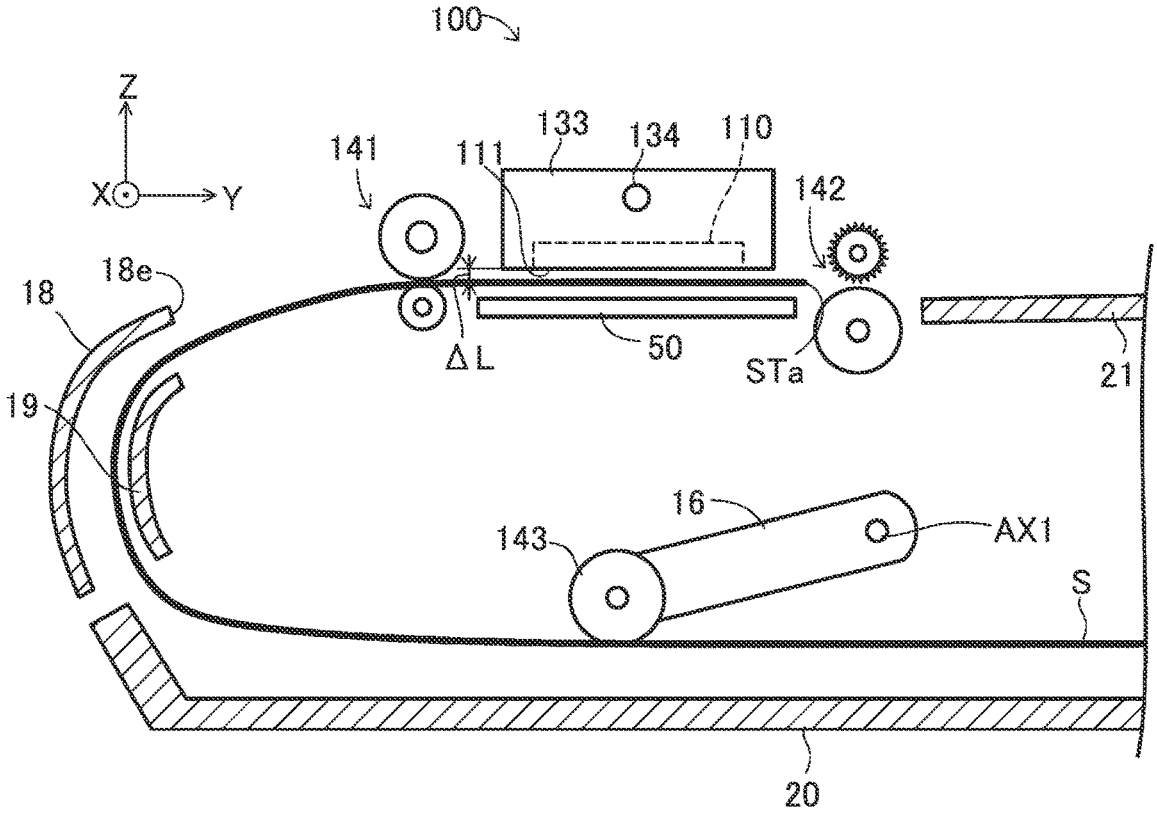
FIG. 4B FIRST HOLDING STATE S1
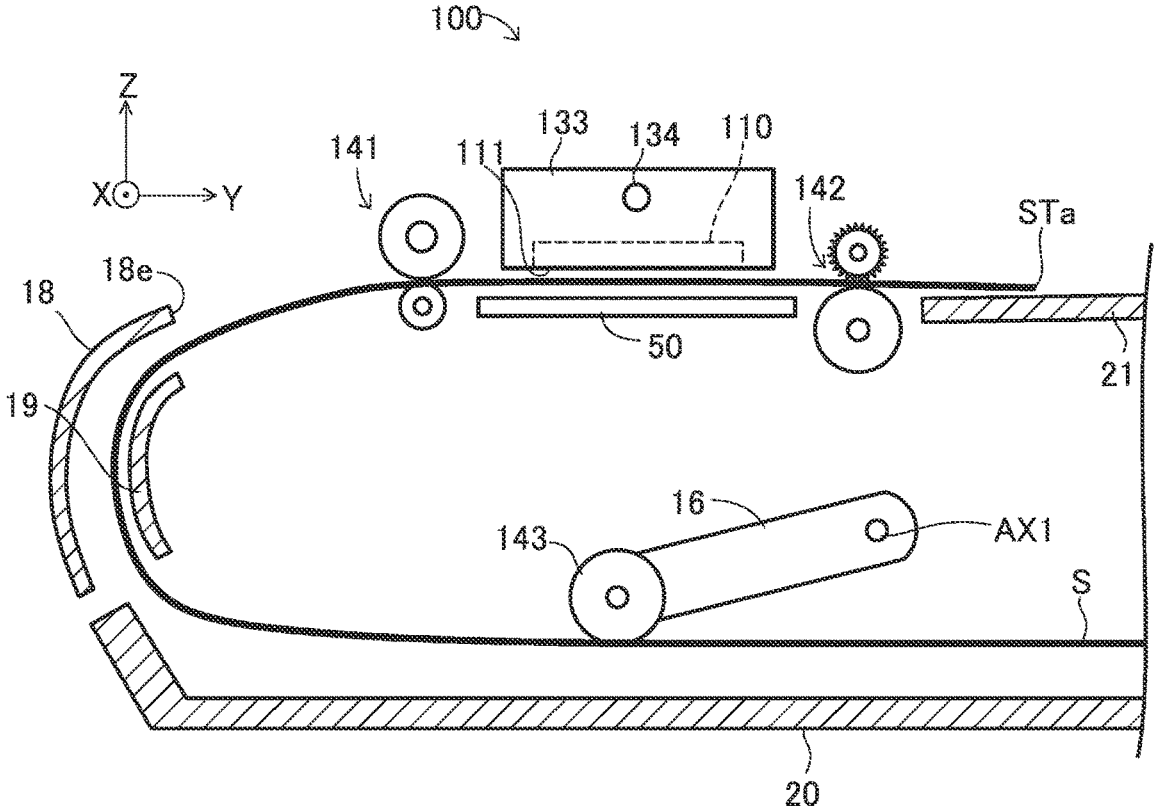

FIG. 5A SECOND HOLDING STATE S2
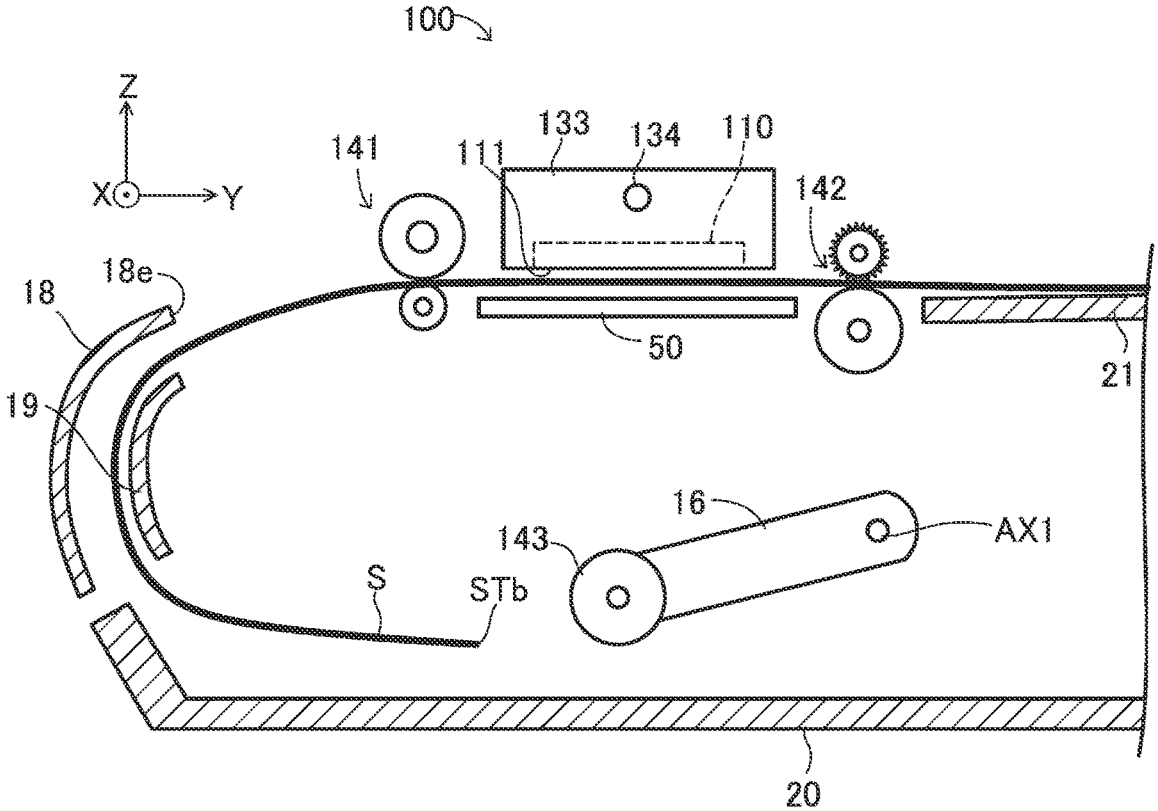
FIG. 5B THIRD HOLDING STATE S3
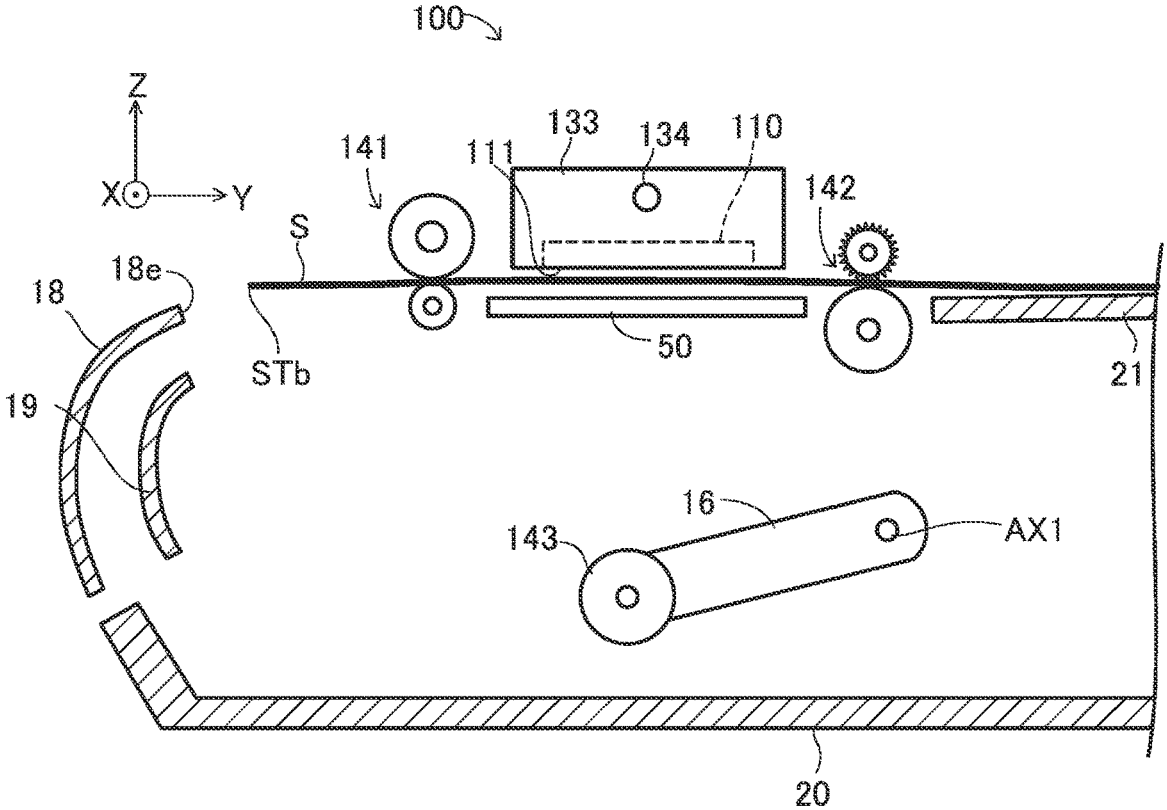

FIG. 5C SECOND HOLDING STATE S2
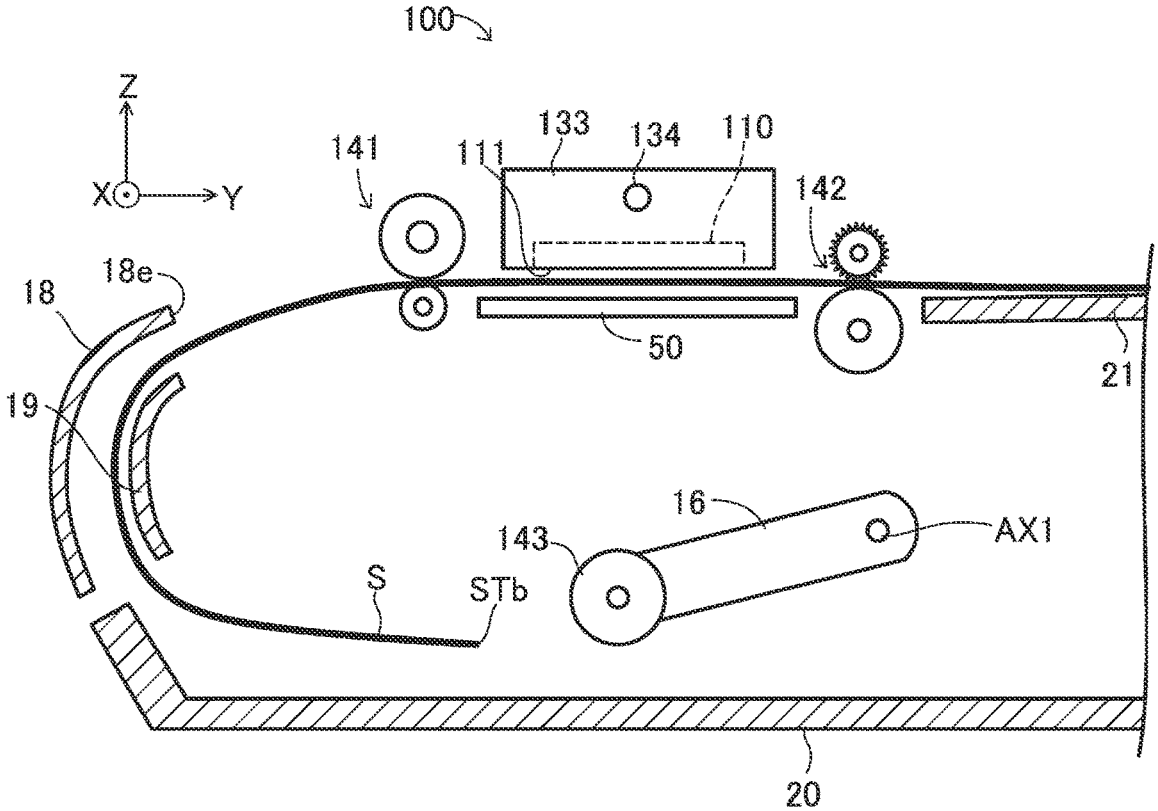
FIG. 5D THIRD HOLDING STATE S3
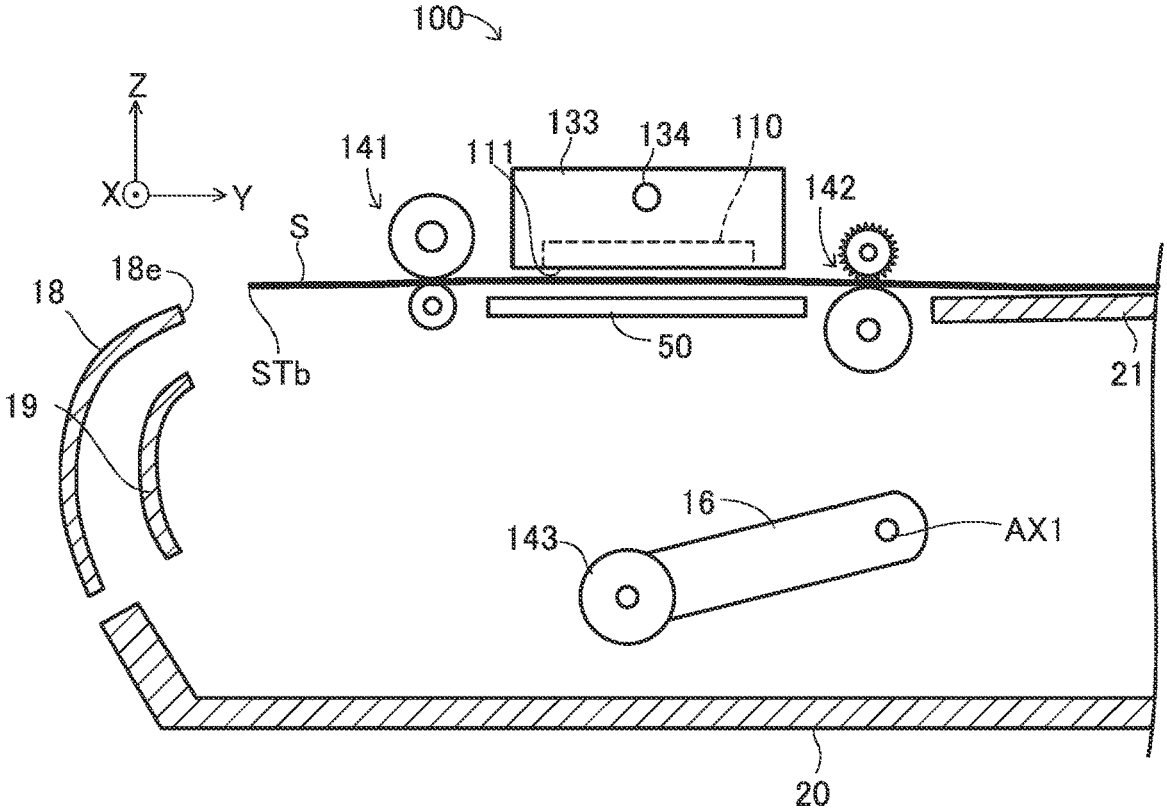

FIG. 6 FOURTH HOLDING STATE S1
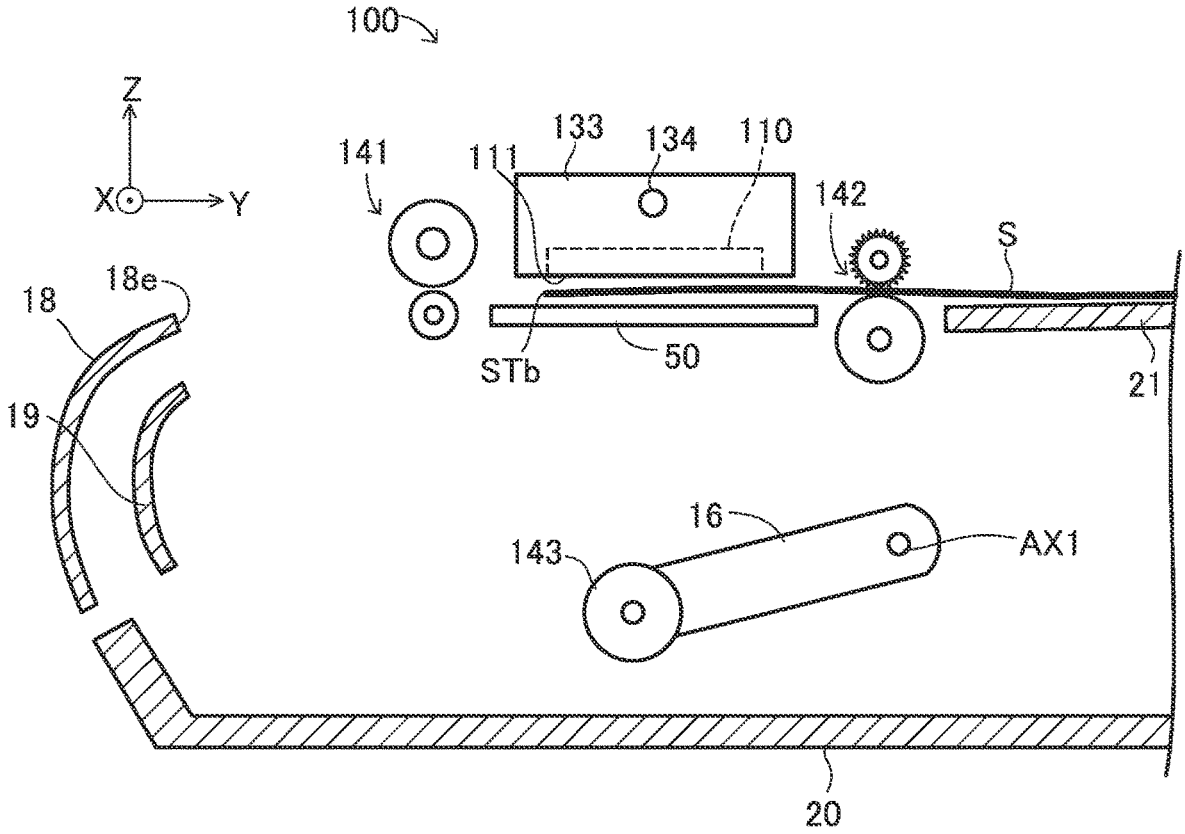
FIG. 7
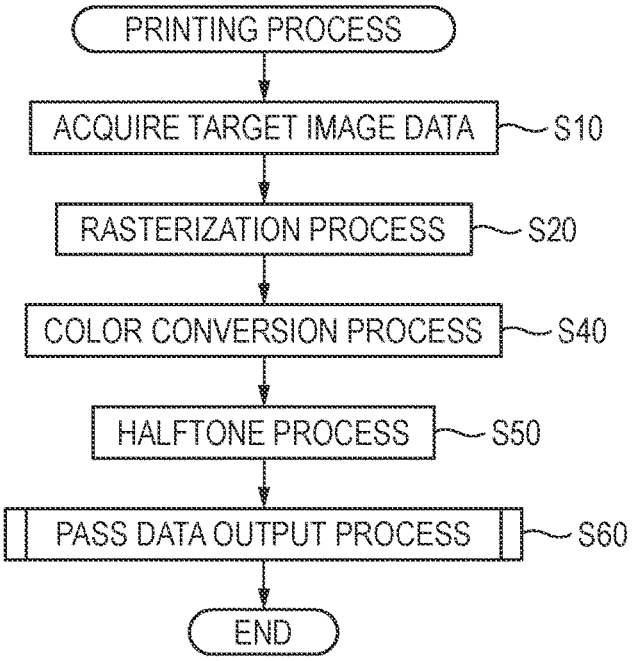

PATTERN DATA

RECORDING RATE

CONTROL DEVICE, NON-TRANSITORY COMPUTER-READABLE MEDIUM, CONTROL METHOD

CROSS-REFERENCE TO RELATED APPLICATION

This application claims priority from Japanese Patent Application No. 2018-059630 filed on Mar. 27, 2018, the entire subject matter of which is incorporated herein by reference.

TECHNICAL FIELD

The present specification relates to a control device to control a printing execution unit including: a print head that includes a plurality of nozzles; and a conveyor that conveys a print medium along a conveying path, a non-transitory computer-readable medium, a control method of a printing execution unit.

BACKGROUND

A background art discloses a serial printer that executes scanning with a print head and executes printing on a band basis. In an overlapping area where printing is executed through two scanning operations, this printer changes a ratio at which printing is executed through a first scanning operation and a ratio at which printing is executed through a second scanning operation according to a density in the overlapping area. As a result, the occurrence of a black streak or a white streak in the overlapping area can be suppressed.

SUMMARY

In the above-described technique, a holding state of sheet during printing is not considered. Therefore, the image quality of a print image may deteriorate depending on the holding state of sheet during printing.

The present specification discloses a technique capable of improving the image quality of a print image by executing printing according to a holding state of a print medium (for example, sheet) during printing.

The technique disclosed in the present specification can be realized as the following application examples.

Application Example 1

A control device that controls a printing execution unit includes: a print head including a plurality of nozzles from which ink is ejected; a head driver configured to cause the print head to eject ink and to form a dot on a print medium; and a conveyor to convey the print medium along a conveying path, to execute printing by alternately executing partial printings, which forms the dot using the print head, and print medium conveying, which conveys the print medium using the conveyor. The conveyor includes: a first roller provided upstream of the print head in the conveying path to hold the print medium; a second roller provided downstream of the print head in the conveying path to hold the print medium; and a third roller provided upstream of the first roller in the conveying path to hold the conveying path including, a curved path that is provided between the first roller and the third roller and is curved when seen from a direction perpendicular to a conveying direction of the print medium and parallel to a printing surface of the print medium to be conveyed. The control device includes a print controller to perform: acquiring print image data representing a print image; causing the printing execution unit to execute the partial printing m times by using the print image data so as to print the print image on the print medium, wherein the print image alternately includes a first partial image that is printed in an n-th partial printing and a second partial image that is printed in the n-th partial printing and an (n+1)-th partial printing, and wherein m represents an integer of 3 or more and n represents an integer of 1 or more and less than m. The first holding state is a state where the print medium is held by the first roller, is held by the second roller, and is held by the third roller, and a second holding state is a state where the print medium is held by the first roller, is held by the second roller, and is not held by the third roller, and a first length, in the conveying direction, of the second partial image that is printed in the first holding state is longer than a second length, in the conveying direction, of the second partial image in which at least a part is printed in the second holding state.

By printing the second partial image, the occurrence of a black streak or a white streak is suppressed, but a difference in density between the second partial image and the first partial image may be generated due to a variation in conveyance amount. This difference in density decreases as the length in the conveying direction of the second partial image increases. Here, in a case where the curved path is provided between the first roller and the third roller, in the second holding state where the print medium is not held by the third roller, the distance between the print medium and the print head is not stable as compared to the first holding state where the print medium is held by the third roller. Therefore, during printing the second holding state S2, a variation in position between a dot that is formed in the n-th partial printing and a dot that is formed in the (n+1)-th partial printing occurs in the second partial image, and the above-described density unevenness is likely to occur in the second partial image. Therefore, it is preferable that the second length in the conveying direction of the second partial image is short during printing in the second holding state. On the other hand, during printing in the first holding state S1 where the distance between the print medium and the print head is stable, the above-described density unevenness is not likely to occur in the second partial image. Therefore, it is preferable that a difference in density between the second partial image and the first partial image is small. Therefore, it is preferable that the first length in the conveying direction of the second partial image is long during printing in the first holding state. According to the above-described configuration, the first length in the conveying direction of the second partial image that is printed in the first holding state is longer than the second length in the conveying direction of the second partial image in which at least a part is printed in the second holding state. As a result, the difference in density between the second partial image and the first partial image and the density unevenness in the second partial image can be more appropriately suppressed according to the holding state of the print medium during printing. Accordingly, by executing printing according to the holding state of the print medium during printing, the image quality of the print image can be improved.

Application Example 2

A control device that controls a printing execution unit includes: a print head including a plurality of nozzles from which ink is ejected; a head driver configured to cause the print head to eject ink and to form a dot on a print medium; and a conveyor to convey the print medium along a conveying path, to execute printing by alternately executing partial printings, which forms the dot using the print head, and print medium conveying, which conveys the print medium using the conveyor. The conveyor includes: a first roller provided upstream of the print head in the conveying path to hold the print medium; a second roller provided downstream of the print head in the conveying path to hold the print medium; and a third roller provided upstream of the first roller in the conveying path to hold the conveying path including, a curved path that is provided between the first roller and the third roller and is curved when seen from a direction perpendicular to a conveying direction of the print medium and parallel to a printing surface of the print medium to be conveyed. The control device includes a print controller to perform: acquiring print image data representing a print image; causing the printing execution unit to execute the partial printing m times by using the print image data so as to print the print image on the print medium, wherein the print image alternately includes a first partial image that is printed in an n-th partial printing and a second partial image that is printed in the n-th partial printing and an (n+1)-th partial printing, and wherein m represents an integer of 3 or more and n represents an integer of 1 or more and less than m. The first holding state is a state where the print medium is held by the first roller, is held by the second roller, and is held by the third roller, a fourth holding state is a state where the print medium is not held by the first roller, is held by the second roller, and is not held by the third roller, a fourth length, in the conveying direction, of the second partial image in which at least a part is printed in the fourth holding state is shorter than a first length, in the conveying direction, of the second partial image that is printed in the first holding state By printing the second partial image, the occurrence of a black streak or a white streak is suppressed. However, in the fourth holding state, in a case where the instability of the distance between the print medium and the print head is predominant as compared to the first holding state, density unevenness is likely to occur in the second partial image. Therefore, in this case, it is preferable that the fourth length in the conveying direction of the second partial image is short during printing in the fourth holding state. According to the above-described configuration, the fourth length in the conveying direction of the second partial image that is printed in the fourth holding state is shorter than the first length in the conveying direction of the second partial image that is printed in the first holding state. As a result, the difference in density between the second partial image and the first partial image and the density unevenness in the second partial image can be more appropriately suppressed according to the holding state of the print medium during printing. Accordingly, by executing printing according to the holding state of the print medium during printing, the image quality of the print image can be improved.

Application Example 3

A control device that controls a printing execution unit includes: a print head including a plurality of nozzles from which ink is ejected; a head driver configured to cause the print head to eject ink and to form a dot on a print medium; and a conveyor to convey the print medium along a conveying path, to execute printing by alternately executing partial printings, which forms the dot using the print head, and print medium conveying, which conveys the print medium using the conveyor. The conveyor includes: a first roller provided upstream of the print head in the conveying path to hold the print medium; a second roller provided downstream of the print head in the conveying path to hold the print medium; and a third roller provided upstream of the first roller in the conveying path to hold the conveying path including, a curved path that is provided between the first roller and the third roller and is curved when seen from a direction perpendicular to a conveying direction of the print medium and parallel to a printing surface of the print medium to be conveyed. The control device includes a print controller to perform: acquiring print image data representing a print image; causing the printing execution unit to execute the partial printing m times by using the print image data so as to print the print image on the print medium, wherein the print image alternately includes a first partial image that is printed in an n-th partial printing and a second partial image that is printed in the n-th partial printing and an (n+1)-th partial printing, and wherein m represents an integer of 3 or more and n represents an integer of 1 or more and less than m. The first holding state is a state where the print medium is held by the first roller, is held by the second roller, and is held by the third roller, a fourth holding state is a state where the print medium is not held by the first roller, is held by the second roller, and is not held by the third roller, and a fourth length, in the conveying direction, of the second partial image in which at least a part is printed in the fourth holding state is longer than the first length, in the conveying direction, of the second partial image that is printed in the first holding state.

By printing the second partial image, the occurrence of a black streak or a white streak is suppressed. However, for example, in the fourth holding state, in a case where a variation in conveyance amount is predominant as compared to the first holding state, a difference in density between the second partial image and the first partial image is likely to occur. Therefore, in this case, it is preferable that the fourth length in the conveying direction of the second partial image is long during printing in the fourth holding state. According to the above-described configuration, the fourth length in the conveying direction of the second partial image that is printed in the fourth holding state is longer than the first length in the conveying direction of the second partial image that is printed in the first holding state. As a result, the difference in density between the second partial image and the first partial image and the density unevenness in the second partial image can be more appropriately suppressed according to the holding state of the print medium during printing. Accordingly, by executing printing according to the holding state of the print medium during printing, the image quality of the print image can be improved.

The technique disclosed in the present specification can be realized in various forms, for example, a printing device, a method of controlling a printing execution unit, a printing method, a computer program for realizing functions of the devices and methods, or a recording medium that stores the computer program.

BRIEF DESCRIPTION OF THE DRAWINGS

The foregoing and additional features and characteristics of this disclosure will become more apparent from the following detailed descriptions considered with the reference to the accompanying drawings, wherein:

FIGS. 4A and 4B are first explanatory diagrams illustrating a holding state of a sheet;

FIGS. 5A and 5B are second explanatory diagrams illustrating a holding state of the sheet;

FIG. 6 is a third explanatory diagram illustrating a holding state of the sheet;

FIG. 7 is a flowchart illustrating a printing process;

DETAILED DESCRIPTION

A. First Example

A-1: Configuration of Printer 200

Figure 1:
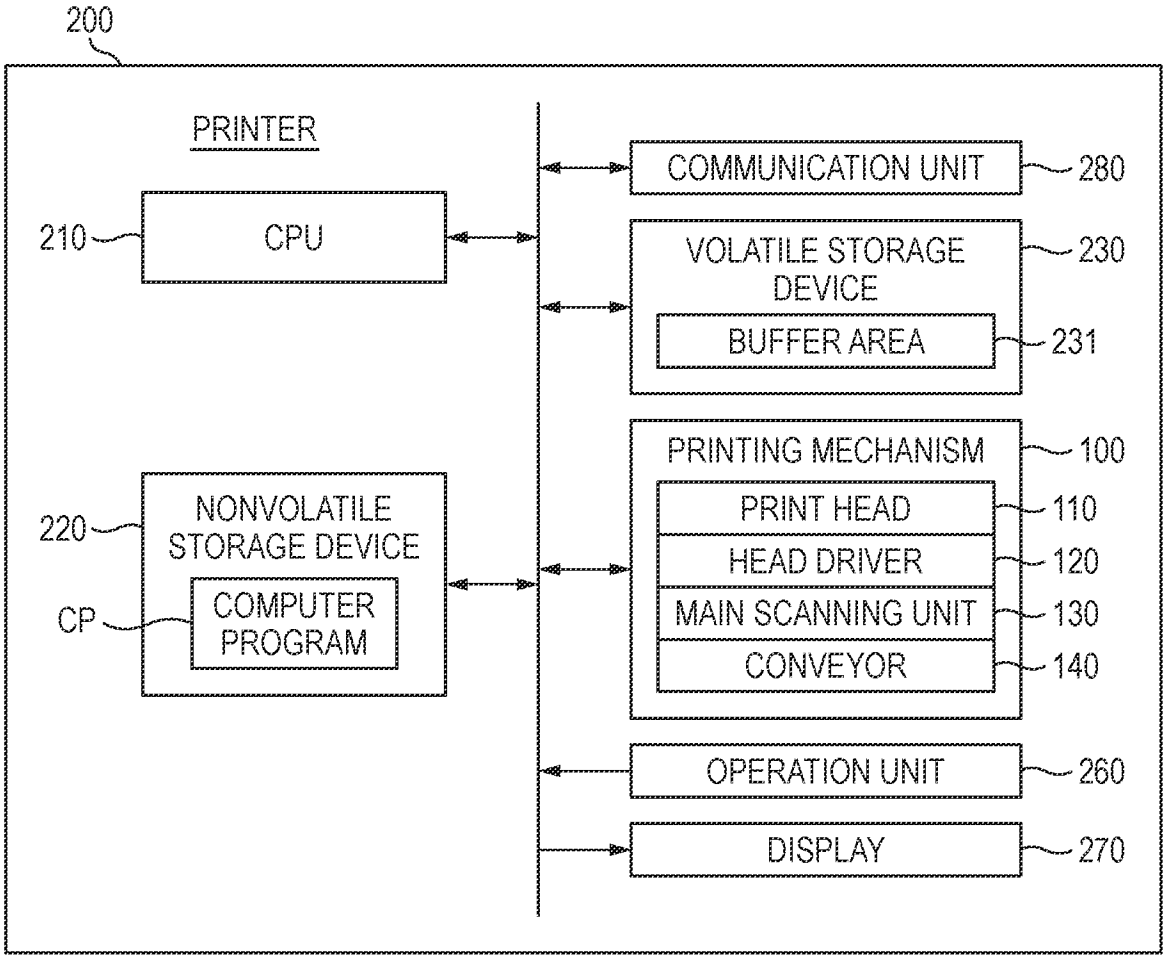
FIG. 1 is a block diagram illustrating a configuration of an example.

Next, an embodiment will be described based on an example. FIG. 1 is a block diagram illustrating a configuration of the example.

For example, a printer 200 includes: a printing mechanism 100; a CPU 210 as a control device for controlling the printing mechanism 100; a nonvolatile storage device 220 such as a hard disk drive; a volatile storage device 230 such as a flash memory; an operation unit 260 such as a button or a touch panel for acquiring an operation of a user; a display 270 such as a liquid crystal display; and a communication unit 280. The printer 200 is connected to an external device (for example, a terminal device of the user (not illustrated)) through the communication unit 280.

The volatile storage device 230 provides a buffer area 231 that temporarily stores various kinds of intermediate data generated when the CPU 210 executes a process. The nonvolatile storage device 220 stores a computer program CP. In this example, the computer program CP is a control program for controlling the printer 200, and may be stored in the nonvolatile storage device 220 at the time of shipment of the printer 200. In addition, the computer program CP may be downloaded from a server. Instead, the computer program CP may be stored in a DVD-ROM or the like. By executing the computer program CP, the CPU 210 controls, for example, the printing mechanism 100 such that a printing process described below is executed.

The printing mechanism 100 ejects respective inks (liquid droplets) of cyan (C), magenta (M), yellow (Y), and black (K) to execute printing. The printing mechanism 100 includes a print head 110, a head driver 120, a main scanning unit 130, and a conveyor 140.

Figure 2:
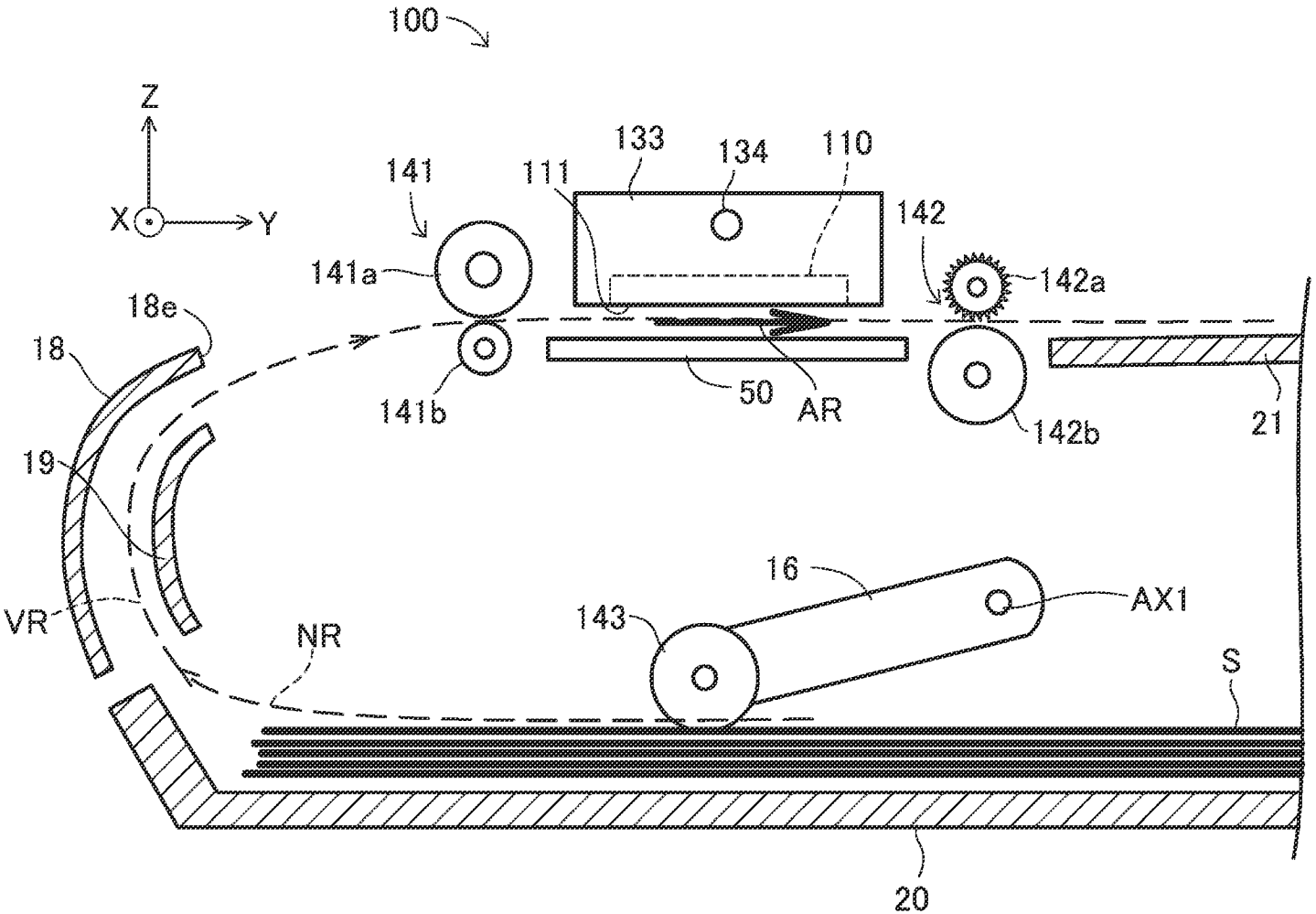
FIG. 2 is a diagram illustrating a schematic configuration of a printing mechanism.

FIG. 2 is a diagram illustrating a schematic configuration of the printing mechanism 100. The printing mechanism 100 further includes: a sheet supply tray 20 where a plurality of sheets S before printing overlap each other and are accommodated; a sheet discharge tray 21 that discharges a printed sheet; and a platen 50 that is disposed to face a nozzle formation surface 111 of the print head 110.

The conveyor 140 passes through the print head 110 and the platen 50 and transports the sheet S along a conveying path TR ranging from the sheet supply tray 20 to the sheet discharge tray 21. The conveying path TR includes a curved path VR as a portion that is curved when seen from along an X direction of FIG. 2. The curved path VR is disposed between a pickup roller 143 and an upstream roller pair 141 described below in the conveying path TR. The X direction is a direction perpendicular to a conveying direction AR and parallel to a printing surface of the sheet S to be conveyed. The upstream side of the conveying path TR will be simply referred to as "upstream side", and the downstream side of the conveying path TR will be simply referred to as "downstream side".

The conveyor 140 includes: an outer guide member 18 that guides the sheet S along the conveying path TR; an inner guide member 19; the pickup roller 143 that is provided in the conveying path TR; the upstream roller pair 141; and a downstream roller pair 142.

The outer guide member 18 and the inner guide member 19 are disposed in the curved path VR. The outer guide member 18 is a member that supports the sheet S from an outer surface (printing surface) side in a state where the sheet S is curved in the curved path VR. The inner guide member 19 is a member that supports the sheet S from an inner surface (surface facing the printing surface) side in a state where the sheet S is curved in the curved path VR.

The pickup roller 143 is attached to a tip of an arm 16 that can rotate around an axis AX1, and holds the sheet S in a state where the sheet S is interposed between the sheet supply tray 20 and the pickup roller 143. In other words, the pickup roller 143 is provided upstream of the upstream roller pair 141 in the conveying path TR and holds the sheet S. The pickup roller 143 separates one sheet S from a plurality of sheets S accommodated in the sheet supply tray 20 and supplies the separated sheet S to the conveying path TR.

The upstream roller pair 141 includes: a driving roller 141*a* that is driven by a motor (not illustrated); and a driven roller 142*b* that rotates along with the rotation of the driving roller 141*a*. Likewise, the downstream roller pair 142 includes a driving roller 142*a* and a driven roller 142*b*. The driven roller 142*b* of the downstream roller pair 142 is a roller that includes a plurality of spurs having a thin plate shape disposed on the same axis. This configuration is to prevent the print image printed on the sheet S from being damaged. The driven roller 141*a*, the driven roller 141*b*, and the driving roller 142*a* are, for example, cylindrical rollers.

The upstream roller pair 141 is provided upstream of the print head 110 and holds the sheet S. The downstream roller pair 142 is provided downstream of the print head 110 and holds the sheet S. The conveying direction AR of FIG. 2 is a conveying direction (+Y direction) of the sheet between the print head 110 and the platen 50.

The main scanning unit 130 includes: a carriage 133 on which the print head 110 is mounted; and a sliding shaft 134 that holds the carriage 133 so as to reciprocate along a main scanning direction (X-axis direction). The main scanning unit 130 causes the carriage 133 to reciprocate along the sliding shaft 134 using power of a main scanning motor (not illustrated). As a result, a main scanning operation of causing the print head 110 to reciprocate along the main scanning direction is realized.

Figure 3:
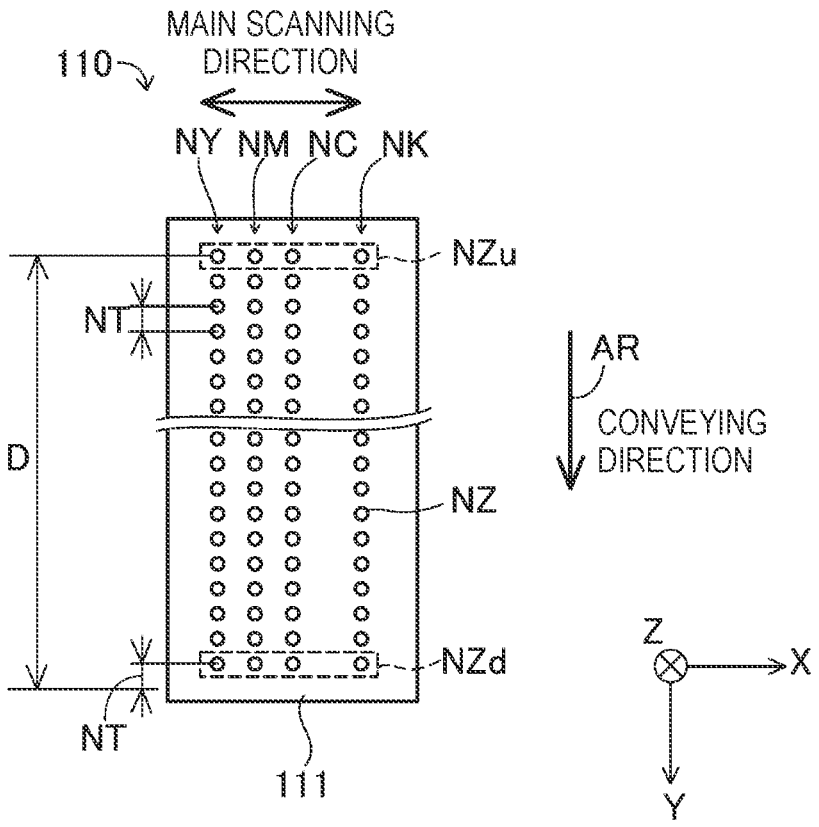
FIG. 3 is a diagram illustrating a configuration of a print head when seen from below in FIG. 2.

FIG. 3 is a diagram illustrating a configuration of the print head 110 when seen from a −Z side (below in FIG. 2). As illustrated in FIG. 3, on the nozzle formation surface 111 of the print head 110 facing the platen 50, a plurality of nozzle arrays each of which includes a plurality of nozzles, that is, nozzle arrays NC, NM, NY, and NK from which the above-described respective inks of C, M, Y, and K are ejected are formed. Each of the nozzle arrays includes a plurality of nozzles NZ. Positions of the nozzles NZ in the conveying direction AR are different from each other, and the nozzles NZ are arranged along the conveying direction at a predetermined nozzle interval NT. The nozzle interval NT refers to the length in the conveying direction between two nozzles NZ adjacent to each other in the conveying direction AR among the nozzles NZ. Among the nozzles constituting each of the nozzle arrays, a nozzle NZ positioned on the most upstream side (−Y side) will also be referred to as "most upstream side nozzle NZu". Among the nozzles constituting each of the nozzle arrays, a nozzle NZ positioned on the most downstream side (+Y side) will also be referred to as "most downstream side nozzle NZd". The length obtained by adding the nozzle interval NT to the length in the conveying direction AR from the most upstream side nozzle NZu to the most downstream side nozzle NZd will also be referred to as "nozzle length D".

The head driver 120 drives the print head 110 that is caused by the main scanning unit 130 to reciprocate on the sheet S to be conveyed by the conveyor 140. That is, the print head 110 ejects the inks from the nozzles NZ of the print head 110 to form dots on the sheet S As a result, an image is printed on the sheet S.

A-2: Holding State of Sheet S

While the sheet S is being conveyed along the conveying path TR from the sheet supply tray 20 to the sheet discharge tray 21, the sheet S is held in five holding states. FIGS. 4A to 6 are explanatory diagrams illustrating the holding states of the sheet S.

FIG. 4A illustrates the sheet S that is held in an initial holding state S0. Hereinafter, a downstream side end of the sheet S that is being conveyed in the conveying path TR will also be referred to as "downstream end of the sheet S", and an upstream side end of the sheet S that is being conveyed in the conveying path TR will also be referred to as "upstream end of the sheet S". In the initial holding state S0, printing is executed on the vicinity of the downstream end of the sheet S that is being conveyed. In the initial holding state S0, in the conveying path TR, a downstream end STa of the sheet is positioned downstream of the upstream roller pair 141 and is positioned upstream of the downstream roller pair 142. In the initial holding state S0, in the conveying path TR, the upstream end (not illustrated in FIG. 4A) of the sheet is positioned upstream of the pickup roller 143. Accordingly, in the initial holding state S0, in the conveying path TR, the sheet S is held by the upstream roller pair 141, is not held by the downstream roller pair 142, and is held by the pickup roller 143.

FIG. 4B illustrates the sheet S that is held in a first holding state S1. Once the sheet S is conveyed after the initial holding state S0 such that the downstream end STa of the sheet S moves downstream of the downstream roller pair 142, the holding state of the sheet S is shifted from the initial holding state S0 to the first holding state S1. In the first holding state S1, in the conveying path TR, the downstream end STa of the sheet is positioned downstream of the downstream roller pair 142, and the upstream end (not illustrated in FIG. 4B) of the sheet is positioned upstream of the pickup roller 143. Accordingly, in the first holding state S1, in the conveying path TR, the sheet S is held by the upstream roller pair 141, is held by the downstream roller pair 142, and is held by the pickup roller 143. In addition, in the first holding state S1, the sheet S is supported from the outer surface side by the outer guide member 18.

FIG. 5A illustrates the sheet S that is held in a second holding state S2. Once the sheet S is conveyed after the first holding state S1 such that an upstream end STb of the sheet S moves downstream of the pickup roller 143, the holding state of the sheet S is shifted from the first holding state S1 to the second holding state S2. In the second holding state S2, in the conveying path TR, the downstream end STa of the sheet is positioned downstream of the downstream roller pair 142. In the second holding state S2, the upstream end Stb of the sheet is positioned downstream of the pickup roller 143 and is positioned upstream of a downstream end 18*e* of the outer guide member 18. Accordingly, in the second holding state S2, in the conveying path TR, the sheet S is held by the upstream roller pair 141, is held by the downstream roller pair 142, and is not held by the pickup roller 143. In addition, in the second holding state S2, the sheet S is supported from the outer surface side by the outer guide member 18.

FIG. 5B illustrates the sheet S that is held in a third holding state S3. Once the sheet S is conveyed after the second holding state S2 such that the upstream end STb of the sheet S moves downstream of the downstream end 18*e* of the outer guide member 18, the holding state of the sheet S is shifted from the second holding state S2 to the third holding state S3. In the third holding state S3, in the conveying path TR, the downstream end STa of the sheet is positioned downstream of the downstream roller pair 142. In the third holding state S3, the upstream end Stb of the sheet is positioned downstream of the pickup roller 143, is positioned upstream of the downstream end 18*e* of the outer guide member 18, and is positioned upstream of the upstream roller pair 141. Accordingly, in the third holding state S3, in the conveying path TR, the sheet S is held by the upstream roller pair 141, is held by the downstream roller pair 142, and is not held by the pickup roller 143. In addition, in the third holding state S3, the sheet S is not supported from the outer surface side by the outer guide member 18.

FIG. 6 illustrates the sheet S that is held in a fourth holding state S4. Once the sheet S is conveyed after the third holding state S3 such that the upstream end STb of the sheet S moves downstream of the upstream roller pair 141, the holding state of the sheet S is shifted from the third holding state S3 to the fourth holding state S4. In the fourth holding state S4, in the conveying path TR, the downstream end STa of the sheet is positioned downstream of the downstream roller pair 142. In the fourth holding state S4, the upstream end STb of the sheet is positioned downstream of the upstream roller pair 141 and is positioned upstream of the downstream roller pair 142. Accordingly, in the fourth holding state S4, in the conveying path TR, the sheet S is not held by the upstream roller pair 141, is held by the downstream roller pair 142, and is not held by the pickup roller 143.

As can be understood from the above description, during printing, the holding state of the sheet that is being conveyed is sequentially shifted to the five states S0 to S4.

A-3. Printing Process

The CPU 210 (FIG. 1) of the printer 200 executes a printing process based on a printing instruction from the user. The printing instruction includes an instruction of image data representing an image to be printed. FIG. 7 is a flowchart illustrating the printing process. In S10, the CPU 210 acquires image data, which is instructed by the printing instruction, from an external device or the volatile storage device 230. The image data refers to image data having various formats such as image data compressed in the JPEG format or image data described in a page description language.

In S20, the CPU 210 executes a rasterization process on the acquired image data to generate RGB image data representing color per pixel as a RGB value As a result, RGB image data is acquired as target image data according to the example. The RGB value is, for example, a color value including three component values of red (R), green (G), and blue (B).

In S40, the CPU 210 executes a color conversion process on the RGB image data to generate CMYK image data representing color per pixel as a CMYK value. The CMYK value is a color value including component values (component values of C, M, Y, and K) corresponding to color materials used for printing. The color conversion process is executed with reference to a well-known lookup table.

In S50, the CPU 210 executes a halftone process on the CMYK image data to generate dot data representing a dot formation state per pixel regarding each of color components of CMYK. A value of each pixel of dot data represents a dot formation state among, for example, two grades including "Dot Absent" and "Dot Present" or four grades including "Dot Absent", "Small", "Medium", and "Large". The halftone process is executed using a well-known method such as a dither method or an error diffusion method. The dot data is image data representing an image (also referred to as "print image" or "dot image") which is formed of dots to be formed on the print medium.

In S60, the CPU 210 executes a pass data output process using the dot data. Specifically, the CPU 210 generates data (pass data) corresponding to one partial printing operation SP described below among the dot data, adds various kinds of control data to the pass data, and outputs the data to the printing mechanism 100. The control data includes data that instructs the conveyance amount of the sheet S conveying operation that is executed after the partial printing operation SP.

As a result, the CPU 210 can cause the printing mechanism 100 to print the print image. Specifically, the CPU 210 controls the head driver 120, the main scanning unit 130, and the conveyor 140 such that printing is executed by alternately executing a partial printing operation SP and a sheet conveying operation T several times. In one partial printing operation SP, while executing one main scanning operation in a state where the sheet S is stopped on the platen 50, the inks are ejected from the nozzles NZ of the print head 110 to the sheet S. As a result, a part of an image to be printed on is printed on the sheet S. In one sheet conveying operation, the sheet S is moved in the conveying direction AR by a predetermined conveyance amount. In the example, the CPU 210 causes the printing mechanism 100 to execute m (m represents an integer of 3 or more) partial printing operations SPm.

Figure 8:
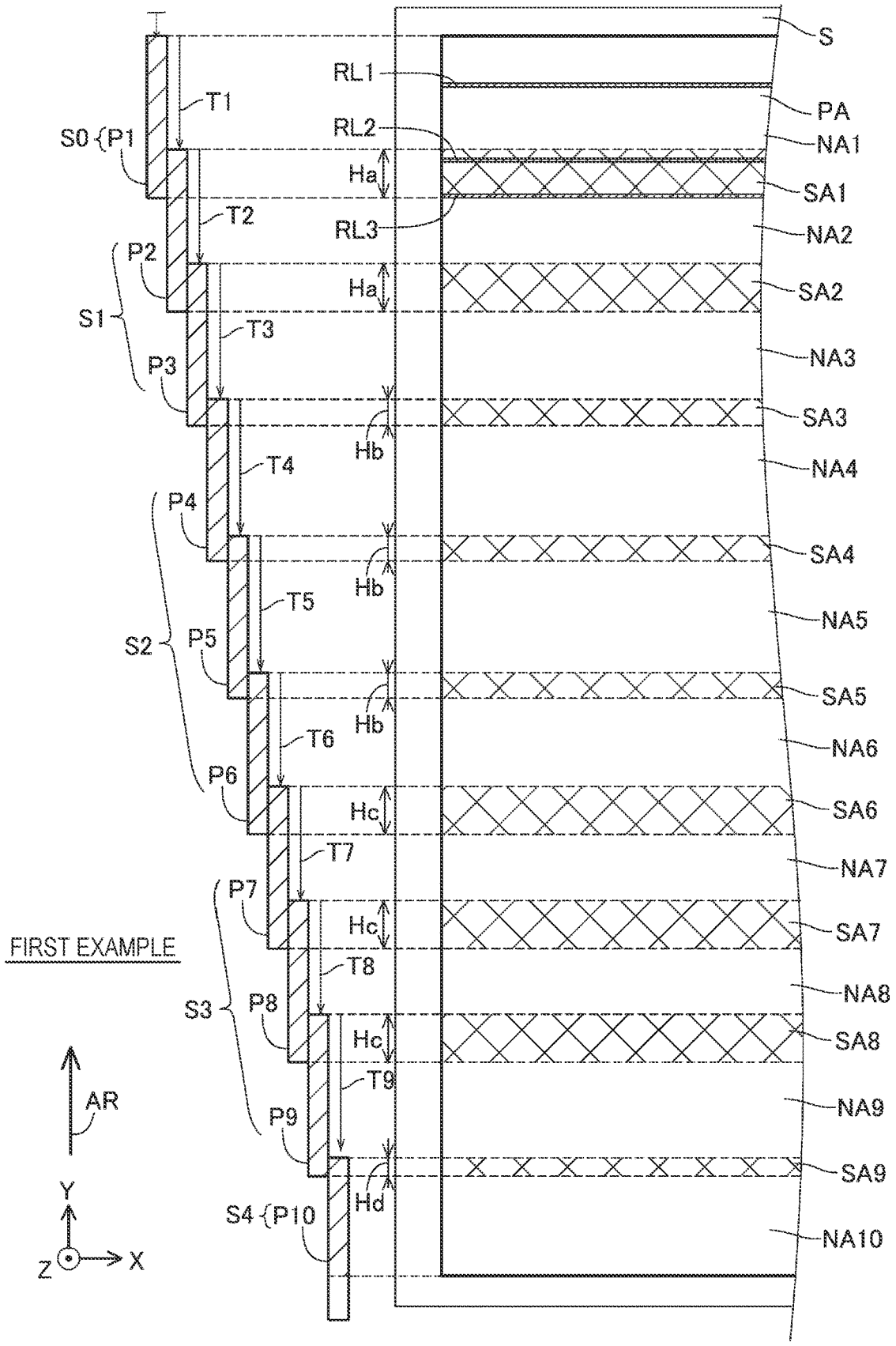
FIG. 8 is a diagram illustrating an example of a relationship between the sheet S and a head position P in a first example.

FIG. 8 is a diagram illustrating an example of a relationship between the sheet S and a head position P in a first example. FIG. 8 illustrates the head position P, that is, a position in the conveying direction of the print head 110 relative to the sheet S per partial printing operation SP (that is, per main scanning operation). Pass numbers k (k represents an integer of 1 to m) are assigned to a plurality of partial printing operations SP in the execution order, respectively, and the k-th partial printing operation will also be referred to as "partial printing operation SPk". A head position P during the partial printing operation SPk will also be referred to as "head position Pk". A sheet conveying operation T that is executed between the k-th partial printing operation SPk and the (k+1)th partial printing operation SP(k+1) will also be referred to as "k-th sheet conveying operation Tk". FIG. 8 illustrates head positions P1 to P10 corresponding to the first to tenth partial printing operations SP1 to SP10, and sheet conveying operations T1 to T9. That is, in the example of FIG. 8, m=10.

In FIG. 8, a print image PA formed on the sheet S includes: a plurality of 1-pass partial images NA1 to NA10 (non-hatched areas in FIG. 8) and a plurality of 2-pass partial images SA1 to SA9 (hatched areas in FIG. 8).

Each of the 1-pass partial images NA1 to NA10 is printed through one partial printing operation. Specifically, the 1-pass partial image Nak is printed only through the k-th partial printing operation SPk, that is, only through the partial printing operation SPk that is executed at the head position Pk.

Each of the 2-pass partial images SA1 to SA9 is printed through two partial printing operations. Specifically, the 2-pass partial image SAk is printed through the k-th partial printing operation SPk and the (k+1)th partial printing operation SP(k+1) That is, the 2-pass partial image SAk is executed through the partial printing operation SPk that is executed at the head position Pk and the partial printing operation SP(k+1) that is executed at the head position P(k+1). An area where the 2-pass partial image SAk is printed will also be referred to as "overlapping area" because it is an area where printing can be executed in an overlapping manner through the two partial printing operations SPk and SP(k+1).

Figure 9:
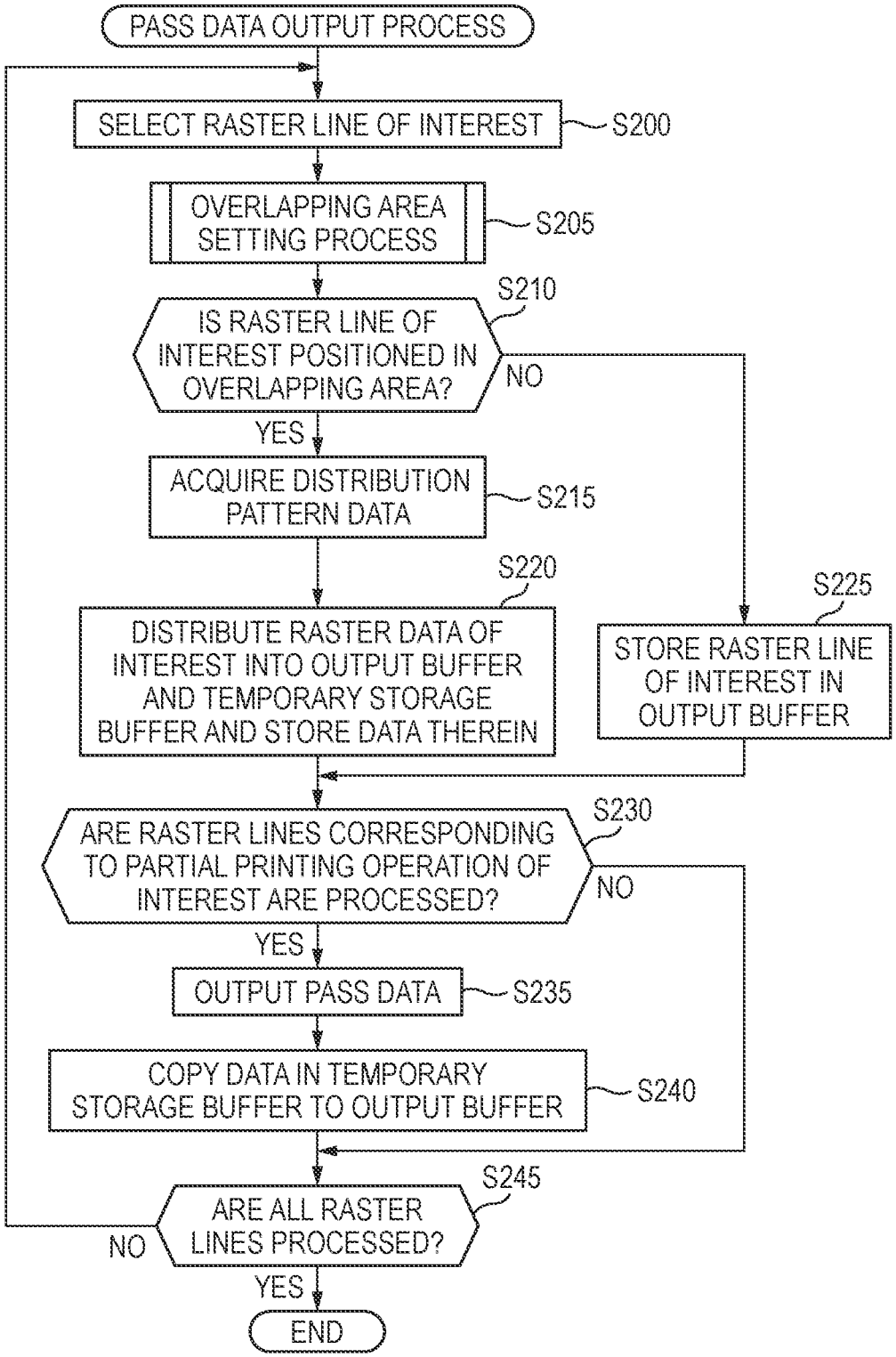
FIG. 9 is a flowchart illustrating a pass data output process.

As described above, the 1-pass partial images NA1 to NA10 and the 2-pass partial images SA1 to SA9 are alternately arranged in the conveying direction AR of the sheet S. The pass data output process (S60 of FIG. 7) for realizing the above-described printing will be described. FIG. 9 is a flowchart illustrating the pass data output process.

The print image PA (FIG. 8) that is represented by the dot data generated in S50 includes a plurality of raster lines RL. For example, as in the case of a raster lines RL1 or RL2 of FIG. 8, the raster line RL is a line extending in a direction perpendicular to the conveying direction AR and includes a plurality of pixels. In S200, the CPU 210 selects one raster line of interest from the raster lines RL. The raster line of interest is selected from each position from the downstream side to the upstream side in the conveying direction AR. Here, a partial printing operation of printing the raster line of interest will also be referred to as "partial printing operation of interest". However, in a case where the raster line of interest is printed through two partial printing operations, that is, in a case where the raster line of interest is positioned in the overlapping area where the 2-pass partial image is printed, the partial printing operation that is executed first among the two partial printing operations is the partial printing operation of interest. For example, in a case where the raster lines RL1 and RL2 are raster lines of interest, the partial printing operation of interest is the partial printing operation SP1 that is executed at the head position P1.

In S205, the CPU 210 executes an overlapping area setting process. The overlapping area setting process is a process that determines the length (also referred to as "overlapping length") in the conveying direction of the overlapping area where the 2-pass partial image is to be printed through the partial printing operation of interest and the partial printing operation that is executed after the partial printing operation of interest. The overlapping length can also be referred to as "the length in the conveying direction of the 2-pass partial image to be printed". For example, in a case where the raster lines RL1 and RL2 of FIG. 8 are raster lines of interest, the length in the conveying direction of the 2-pass partial image SA1 is determined. The overlapping area setting process is executed per raster line, and the same result is obtained in all the raster lines corresponding to the same partial printing operation of interest.

In S210, the CPU 210 determines whether or not the raster line of interest is positioned in the overlapping area where the 2-pass partial image is printed. In S205, since the overlapping length is determined, the CPU 210 can determine whether or not the current raster line of interest is positioned in the overlapping area.

Figure 10A:
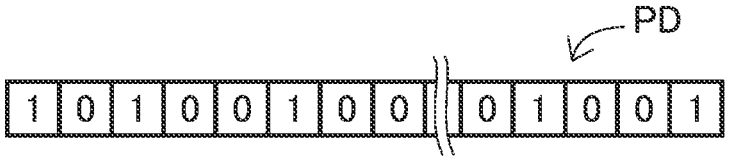
FIGS. 10A and 10B are diagrams illustrating distribution pattern data and recording rates of partial printing operations at head positions.
Figure 10B:
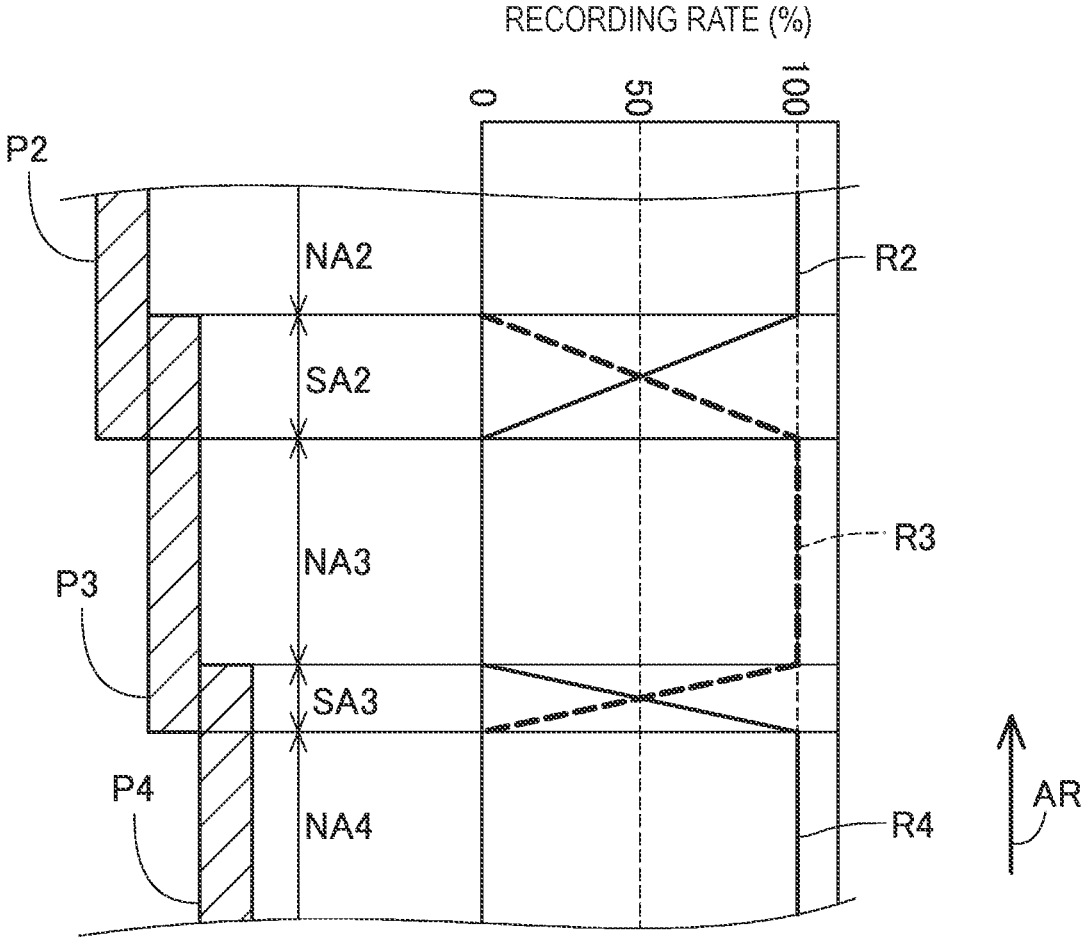

In a case where the raster line of interest is positioned in the overlapping area (S210: YES), in S215, the CPU 210 acquires distribution pattern data PD corresponding to the raster line of interest. FIGS. 10A and 10B are diagrams illustrating the distribution pattern data PD and recording rates of partial printing operations at the head positions P2 to P4. As illustrated in FIG. 10A, the distribution pattern data is binary data having a value corresponding to each pixel of the raster line of interest. The value "0" of the distribution pattern data PD represents that a dot corresponding to the pixel is to be formed through the partial printing operation of interest. The value "1" of the distribution pattern data PD represents that a dot corresponding to the pixel is to be formed through the partial printing operation after the partial printing operation of interest.

Here, recording rates R2, R3, and R4 of FIG. 10B are recording rates in partial printing operations SP2, SP3, and SP4 at the head positions P2, P3, and P4, respectively. FIG. 10B illustrate the respective recording rates R2, R3, and R4 corresponding to the positions in the conveying direction AR. In a range of the conveying direction AR corresponding to the 1-pass partial image NA2 (FIG. 8), the recording rate R2 is 100%. Likewise, in a range of the conveying direction AR corresponding to the 1-pass partial images NA3 and NA4 (FIG. 8), the recording rates R3 and R4 are 100%.

In a range of the conveying direction AR corresponding to the 2-pass partial image SA2 (FIG. 8), the recording rate R2 linearly decreases toward the upstream side (downward in FIG. 10B) in the conveying direction AR. In a range of the conveying direction AR corresponding to the 2-pass partial image SA2 (FIG. 8), the recording rate R3 linearly decreases toward the downstream side (upward in FIG. 10B) in the conveying direction AR. In a range of the conveying direction AR corresponding to the 2-pass partial image SA2 (FIG. 8), the sum of the recording rate R2 and the recording rate R3 is 100%. In a range of the conveying direction AR corresponding to the 2-pass partial image SA3 (FIG. 8), the sum of the recording rates R3 and R4 is also 100%.

FIG. 10B illustrates the recording rate regarding only the partial printing operations at the head positions P2 to P4. However, the recording rates show the same behavior at other head positions P5 to P10. As a result, each of the 1-pass partial images NA1 to NA10 and the 2-pass partial images SA1 to SA9 can be printed at a recording rate of 100%.

The distribution pattern data PD is generated so as to realize the above-described recording rate according to the position in the conveying direction AR in the overlapping area where the 2-pass partial image is printed.

In S220, the CPU 210 distributes data (also referred to as "raster data of interest") corresponding to the raster line of interest among the dot data into an output buffer and a temporary storage buffer and stores the data therein according to the distribution pattern data PD. That is, in the raster data of interest, data representing a dot to be formed through the partial printing operation of interest is stored in the output buffer, and data representing a dot to be formed through the partial printing operation after the partial printing operation of interest is stored in the temporary storage buffer.

In a case where the raster line of interest is not positioned in the overlapping area (S210: NO), all the dots corresponding to a plurality of pixels included in the raster line of interest are to be formed through the partial printing operation of interest. Accordingly, in this case, in S225, the CPU 210 stores the raster data of interest among the dot data in the output buffer.

In S230, the CPU 210 determines whether or not all the raster lines corresponding to the partial printing operation of interest are processed as the raster lines of interest. For example, in a case where the partial printing operation SP1 that is executed at head position P1 of FIG. 8 is the partial printing operation of interest, when the raster line RL3 that is positioned on the most upstream side in the conveying direction AR among the raster lines RL corresponding to the head position P1 is the raster line of interest, it is determined that all the raster lines corresponding to the partial printing operation of interest are processed.

In a case where all the raster lines corresponding to the partial printing operation of interest are processed (S230: YES), at this point, dot data corresponding to the partial printing operation of interest is stored in the output buffer. Accordingly, in this case, in S235, the CPU 210 outputs the dot data corresponding to the partial printing operation of interest to the printing mechanism 100 as pass data. At this time, control data representing the conveyance amount of the sheet conveying operation to be executed after the partial printing operation of interest is added to the pass data to be output. The conveyance amount of the sheet conveying operation to be executed after the partial printing operation of interest is a value that is determined according to the overlapping length determined in S205. For example, in a case where the overlapping length is determined as Ha, the CPU 210 calculates a value obtained by subtracting Ha from the nozzle length D as the conveyance amount TV of the sheet conveying operation T, and adds control data representing the conveyance amount TV to the pass data to be output.

In S240, the CPU 210 deletes the output pass data from the output buffer, and copies the data stored in the temporary storage buffer to the output buffer. For example, at the time when the final raster line RL3 corresponding to the head position P1 of FIG. 8 is processed, a raster line in the overlapping area where the 2-pass partial image SA1 is to be printed among a plurality of raster lines corresponding to the head position P2 is already processed. Among the raster data corresponding to the processed raster lines, data used in the partial printing operation SP2 that is executed at the head position P2 is already stored in the temporary storage buffer. In this step, the data is copied to the output buffer.

In a case where an unprocessed raster line corresponding to the partial printing operation of interest is present (S230: NO), the CPU 210 skips S 235 and S240.

In S245, the CPU 210 determines whether or not all the raster lines in the print image PA are processed as the raster lines of interest. In a case where an unprocessed raster line is present (S245: NO), the CPU 210 returns to S200 and selects the unprocessed raster line as the raster line of interest. In a case where all the raster lines are processed (S245: YES), the CPU 210 ends the pass data output process.

Figure 11:
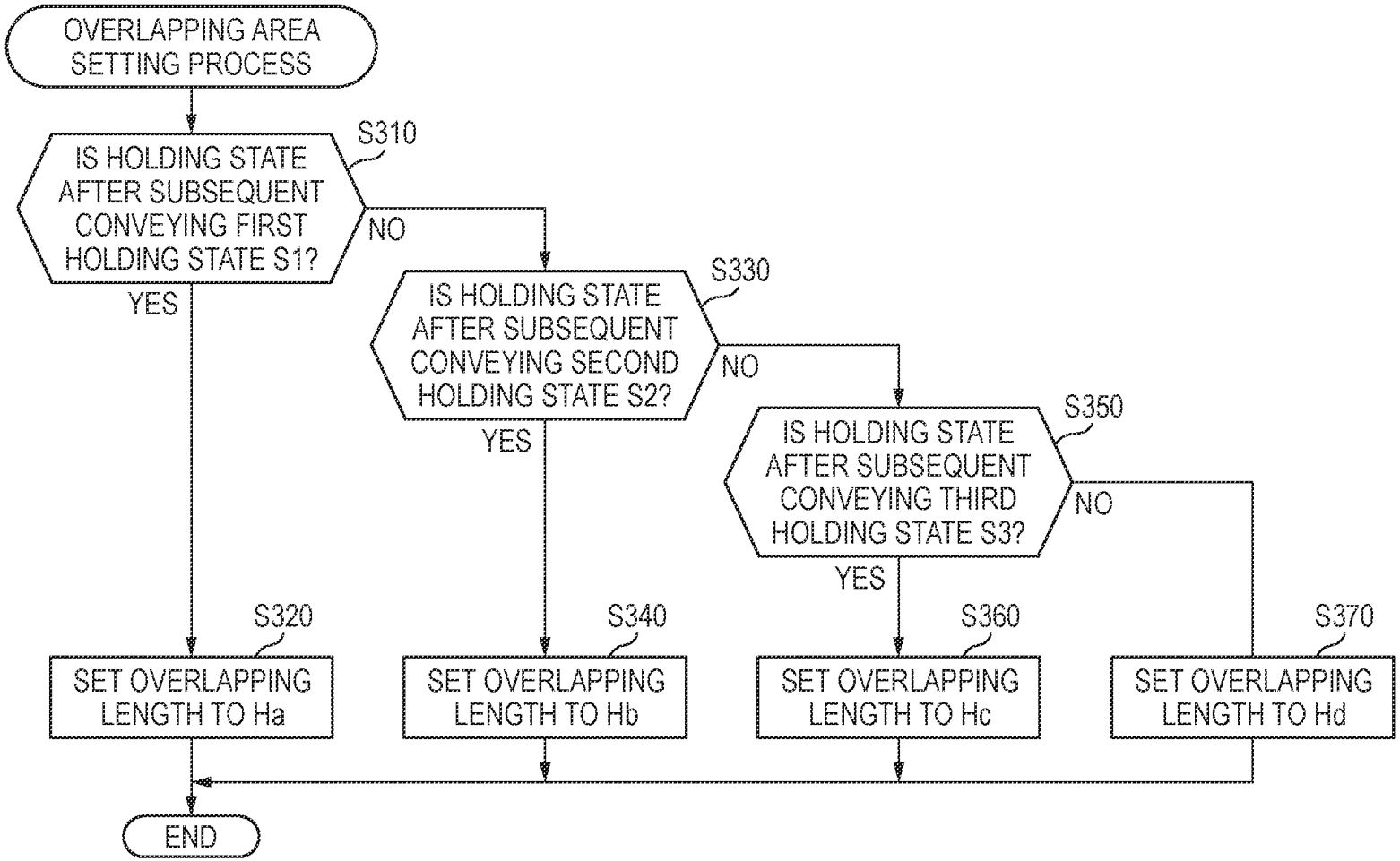
FIG. 11 is a flowchart illustrating an overlapping area setting process.

The overlapping area setting process of S205 of FIG. 9 will be described. FIG. 11 is a flowchart illustrating the overlapping area setting process. In S310, the CPU 210 determines whether or not the holding state of the sheet S after the subsequent conveying is the first holding state S1. The subsequent conveying refers to the sheet conveying operation T that is executed after executing the current partial printing operation of interest. The CPU 210 stores the sum of the conveyance amounts from the start of the conveying of the sheet S in the volatile storage device 230, and adds the subsequent conveyance amount to the sum to estimate the sum of the conveyance amounts of the sheet S after the subsequent conveying. In addition, in the nonvolatile storage device 220, the length in the conveying direction of the sheet S (for example, the length in the conveying direction of an A4-sized sheet) and the positions of the pickup roller 143, the downstream end of the outer guide member 18, and the upstream roller pair 141 in the conveying path TR are stored in advance. Based on these values, the CPU 210 can determine whether the holding state of the sheet S after the subsequent conveying is the holding state S1, S2, S3, or S4.

Here, in FIG. 8, when the partial printing operation is executed at each of the head positions P1 to P10, the holding state of the sheet S is represented using reference numerals S0 to S4. As illustrated in FIG. 8, the partial printing operation SP1 that is executed at the head position P1 is executed in the initial holding state S0 (FIG. 4A). The partial printing operations SP2 and SP3 that are executed at the head positions P2 and P3 are executed in the first holding state S1 (FIG. 4B). The partial printing operations SP4 to SP6 that are executed at the head positions P4 to P6 are executed in the second holding state S2 (FIG. 5A). The partial printing operations SP7 to SP9 that are executed at the head positions P7 to P9 are executed in the third holding state S3 (FIG. 5B). The partial printing operation SP10 that is executed at the head position P10 is executed in the fourth holding state S4 (FIG. 6).

Accordingly, in the example of FIG. 8, during the sheet conveying operation T3 that is executed between the partial printing operation SP3 and the partial printing operation SP4, the holding state is shifted from the first holding state S1 to the second holding state S2. Therefore, in S310, in a case where the partial printing operation of interest is the partial printing operation SP1 or SP2, it is determined that the holding state of the sheet S after the subsequent conveying is the first holding state S1. In a case where the partial printing operation of interest is any one of the partial printing operations SP3 to SP10, it is determined that the holding state of the sheet S after the subsequent conveying is not the first holding state S1.

In a case where the holding state of the sheet S after the subsequent conveying is the first holding state S1 (S310: YES), in S320, the CPU 210 determines the overlapping length, in which the 2-pass partial image is to be printed through the partial printing operation of interest and the partial printing operation after the partial printing operation of interest, as Ha. For example, the conveyance amount TV of the sheet conveying operation T that is executed after the partial printing operation of interest is set as a value obtained by subtracting Ha from the nozzle length D (TV=D−Ha). Accordingly, in S235 of FIG. 9, control data representing the conveyance amount TV is added to the pass data. As a result, for example, the conveyance amounts of the sheet conveying operations T1 and T2 of FIG. 8 are set as (D−Ha), and the lengths in the conveying direction AR of the 2-pass partial images SA1 and SA2 are set as Ha.

In a case where the holding state of the sheet S after the subsequent conveying is not the first holding state S1 (S310: NO), in S330, the CPU 210 determines whether or not the holding state of the sheet S after the subsequent conveying is the second holding state S2. In the example of FIG. 8, during the sheet conveying operation T7 that is executed between the partial printing operation SP6 and the partial printing operation SP7, the holding state is shifted from the second holding state S2 to the third holding state S3. Therefore, in S330, in a case where the partial printing operation of interest is any one of the partial printing operations SP3 to SP5, it is determined that the holding state of the sheet S after the subsequent conveying is the second holding state S2. In a case where the partial printing operation of interest is any one of the partial printing operations SP6 to SP10, it is determined that the holding state of the sheet S after the subsequent conveying is not the second holding state S2.

In a case where the holding state of the sheet S after the subsequent conveying is the second holding state S2 (S330: YES), in S340, the CPU 210 determines the overlapping length, in which the 2-pass partial image is to be printed through the partial printing operation of interest and the partial printing operation after the partial printing operation of interest, as Hb. For example, the conveyance amount TV of the sheet conveying operation T that is executed after the partial printing operation of interest is set as a value obtained by subtracting Hb from the nozzle length D (TV=D−Hb). Accordingly, in S235 of FIG. 9, control data representing the conveyance amount TV is added to the pass data. As a result, for example, the conveyance amounts of the sheet conveying operations T3 to T5 of FIG. 8 are set as (D−Hb), and the lengths in the conveying direction AR of the 2-pass partial images SA3 to SA5 are set as Hb. The overlapping length Hb is shorter than the overlapping length Ha.

In a case where the holding state of the sheet S after the subsequent conveying is not the second holding state S2 (S330: NO), in S350, the CPU 210 determines whether or not the holding state of the sheet S after the subsequent conveying is the third holding state S3. In the example of FIG. 8, during the sheet conveying operation T9 that is executed between the partial printing operation SP9 and the partial printing operation SP10, the holding state is shifted from the third holding state S3 to the fourth holding state S4. Therefore, in S350, in a case where the partial printing operation of interest is any one of the partial printing operations SP6 to SP8, it is determined that the holding state of the sheet S after the subsequent conveying is the third holding state S3. In a case where the partial printing operation of interest is any one of the partial printing operations SP9 and SP10, it is determined that the holding state of the sheet S after the subsequent conveying is not the third holding state S3.

In a case where the holding state of the sheet S after the subsequent conveying is the third holding state S3 (S350: YES), in S360, the CPU 210 determines the overlapping length, in which the 2-pass partial image is to be printed through the partial printing operation of interest and the partial printing operation after the partial printing operation of interest, as Hc. For example, the conveyance amount TV of the sheet conveying operation T that is executed after the partial printing operation of interest is set as a value obtained by subtracting Hc from the nozzle length D (TV=D−Hc). Accordingly, in S235 of FIG. 9, control data representing the conveyance amount TV is added to the pass data. As a result, for example, the conveyance amounts of the sheet conveying operations T6 to T8 of FIG. 8 are set as (D−Hc), and the lengths in the conveying direction AR of the 2-pass partial images SA6 to SA8 are set as Hc. The overlapping length Hc is equal to the overlapping length Ha and is longer than the overlapping length Hb.

In a case where the holding state of the sheet S after the subsequent conveying is not the third holding state S3 (S350: NO), in S370, the CPU 210 determines the overlapping length, in which the 2-pass partial image is to be printed through the partial printing operation of interest and the partial printing operation after the partial printing operation of interest, as Hd. For example, the conveyance amount TV of the sheet conveying operation T that is executed after the partial printing operation of interest is set as a value obtained by subtracting Hd from the nozzle length D (TV=D−Hd). Accordingly, in S235 of FIG. 9, control data representing the conveyance amount TV is added to the pass data. As a result, for example, the conveyance amount of the sheet conveying operation T9 of FIG. 8 is set as (D−Hd), and the length in the conveying direction AR of the 2-pass partial image SA9 is set as Hd. The overlapping length Hd is shorter than the overlapping lengths Ha, Hb, and Hc.

The print image PA that is printed on the sheet S in the above-described example will be described in detail with reference to FIG. 8.

In the print image PA, the 1-pass partial images NA1 to NA10 and the 2-pass partial images SA1 to SA9 are alternately arranged in the conveying direction AR of the sheet S. The reason why the 2-pass partial images SA1 to SA9 are provided as described above are as follows. It is assumed that the print image includes only the 1-pass partial images. In this case, due to a variation in the conveyance amount of the sheet S, a defect so-called banding in which a white streak or a black streak appears at a boundary between two 1-pass partial images adjacent to each other in the conveying direction AR is likely to occur. By providing a 2-pass partial image between the two 1-pass partial images, the occurrence of banding can be suppressed. Printing of providing the 2-pass partial image between the two 1-pass partial images will also be referred to as "partial 2-pass printing". For example, in a case where the nozzles NZ corresponding to the nozzle length D are used, the partial 2-pass printing can be realized by adjusting the conveyance amount Δd of the sheet S to be more than (½)D and to be less than D ((½)D<ΔD<D).

As described above with reference to FIGS. 10A and 10B, theoretically, in the 2-pass partial image SA2, the sum of the recording rates of the partial printing operation SP2 and the partial printing operation SP3 is 100%. Here, in a case where the position of the head position P3 relative to the head position P2 deviates from a target position due to a variation in the conveyance amount of the sheet S, the sum of recording rates deviates from 100% in the 2-pass partial image SA2. As a result, in this case, the density of the 2-pass partial image SA2 deviates from a target value, and thus there is a difference in density between the 2-pass partial image SA2 and the 1-pass partial images NA2 and NA3. Even in a case where the position of the head position P4 relative to the head position P3 deviates from a target position, there is also a difference in density between the 2-pass partial image SA3 and the 1-pass partial images NA3 and NA4.

As illustrated in FIG. 10B, a slope of the recording rate in a range of the conveying direction AR corresponding to the 2-pass partial image (FIG. 8) becomes gentler as the length in the conveying direction AR of the 2-pass partial image increases. For example, the length Ha (FIG. 8) in the conveying direction AR of the 2-pass partial image SA2 is longer than the length Hb in the conveying direction AR of the 2-pass partial image SA3. Therefore, a slope of the recording rate in a range of the conveying direction AR corresponding to the 2-pass partial image SA2 is gentler than that in a range of the conveying direction corresponding to the 2-pass partial image SA3. Accordingly, as the length in the conveying direction AR of the 2-pass partial image increases, a change in the density of the 2-pass partial image generated due to a variation in the conveyance amount of the sheet S decreases. Therefore, from the viewpoint of suppressing a difference in density between the 1-pass partial image and the 2-pass partial image, it is preferable that the length in the conveying direction of the 2-pass partial image is long.

On the other hand, for example, in a case where a distance ΔL (FIG. 4A) from the nozzle formation surface 111 of the print head 110 to the sheet S deviates from a target distance, a time Δt required from the ejection of the inks from the nozzles NZ to the landing of the inks on the sheet S during the main scanning operation deviates from a target time. As a result, in the partial printing operation, a position at which a dot is to be formed deviates from a target position in the main scanning direction. This dot positional deviation occurs, for example, in a case where the holding state of the sheet S is unstable. Due to this dot positional deviation, among the two partial printing operations of printing the 2-pass partial image (for example, the 2-pass partial image SA2 of FIG. 8), the position of a dot in one partial printing operation may deviate from the position of a dot in another partial printing operation. In this case, density unevenness is generated in the 2-pass partial image such that an unintentional pattern or the like may appear. This density unevenness in the 2-pass partial image becomes more noticeable as the length in the conveying direction AR of the 2-pass partial image increases. Accordingly, from the viewpoint of suppressing the density unevenness in the 2-pass partial image, it is preferable that the length in the conveying direction of the 2-pass partial image is short.

As illustrated in FIG. 8, the length Ha in the conveying direction AR of the 2-pass partial images SA1 and SA2 is longer than the length Hb in the conveying direction AR of the 2-pass partial images SA3 to SA6. The length Hb in the conveying direction AR of the 2-pass partial images SA3 to SA6 is shorter than the length Hc in the conveying direction AR of the 2-pass partial images SA7 and SA8 (Hb<Hc). The length Ha in the conveying direction AR of the 2-pass partial images SA1 and SA2 is equal to the length Hc in the conveying direction AR of the 2-pass partial images SA7 and SA8 (Ha=Hc). The length Hd in the conveying direction AR of the 2-pass partial image SA9 is shorter than the length Ha in the conveying direction AR of the 2-pass partial images SA1 and SA2 (Hd<Ha). The length Hd in the conveying direction AR of the 2-pass partial image SA9 is shorter than the length Hb in the conveying direction AR of the 2-pass partial images SA3 to SA6 (Hd<Hb).

Here, the 2-pass partial image SA1 is printed through the partial printing operation SP1 that is executed in the initial holding state S0 and the partial printing operation SP2 that is executed in the first holding state S1. The 2-pass partial image SA2 is printed through the partial printing operations SP2 and SP3 that are executed in the first holding state S1. The 2-pass partial image SA3 is printed through the partial printing operation SP3 that is executed in the first holding state S1 and the partial printing operation SP4 that is executed in the second holding state S2. The 2-pass partial images SA4 to SA6 are printed through the partial printing operation that is executed in the second holding state S2. The 2-pass partial image SA7 is printed through the partial printing operation SP7 that is executed in the second holding state S2 and the partial printing operation SP8 that is executed in the third holding state S3. The 2-pass partial image SA8 is printed through the partial printing operations SP8 and SP9 that are executed in the third holding state S3. The 2-pass partial image SA9 is printed through the partial printing operation SP9 that is executed in the third holding state S3 and the partial printing operation SP10 that is executed in the fourth holding state S4.

According to the example, the length Ha in the conveying direction AR of the 2-pass partial image SA2 that is printed in the first holding state S1 is longer than the length Hb in the conveying direction AR of the 2-pass partial images SA3 to SA6 at least a part of which are printed in the second holding state S2. As a result, by executing printing according to the holding state of the sheet S during printing, the image quality of the print image PA can be improved.

The more detailed description will be made. As described above, a difference in density between the 2-pass partial image and the 1-pass partial image may be generated due to a variation in conveyance amount. This difference in density decreases as the length in the conveying direction AR of the 2-pass partial image increases. Here, in a case where the curved path VR is provided between the upstream roller pair 141 and the pickup roller 143, in the second holding state S2 (FIG. 5A) where the sheet S is not held by the pickup roller 143, the distance ΔL between the sheet S and the print head 110 is not stable as compared to the first holding state S1 (FIG. 4B) where the sheet S is held by the pickup roller 143. The reason for this is that, in the second holding state S2 where the sheet S is not held by the pickup roller 143, the sheet S is likely to be bent between the upstream roller pair 141 and the downstream roller pair 142 due to bending of the sheet S in the curved path VR. Therefore, in the partial printing operation that is executed in the second holding state S2, a variation in position between a dot that is formed in a n-th partial printing operation and a dot that is formed in a (n+1)-th partial printing operation occurs in the 2-pass partial image, and the above-described density unevenness is likely to occur in the 2-pass partial image. Therefore, it is preferable that the length in the conveying direction of the 2-pass partial image is short during printing in the second holding state S2. On the other hand, in the partial printing operation that is executed in the first holding state S1 where the distance ΔL between the sheet S and the print head 110 is stable, the above-described density unevenness is not likely to occur in the 2-pass partial image. Therefore, it is preferable that a difference in density between the 2-pass partial image and the 1-pass partial image is small. Therefore, it is preferable that the length in the conveying direction of the 2-pass partial image is long during printing in the first holding state S1. According to the example, the length Ha in the conveying direction AR of the 2-pass partial image SA2 that is printed in the first holding state S1 is longer than the length Hb in the conveying direction AR of the 2-pass partial images SA3 to SA6 at least a part of which are printed in the second holding state S2. Therefore, a difference in density between the 2-pass partial image and the 1-pass partial image and density unevenness in the 2-pass partial image can be appropriately suppressed according to the holding state of the sheet S during printing.

Further, in the example, the length Hb in the conveying direction AR of the 2-pass partial images SA4 to SA6 that are printed in the second holding state S2 is shorter than the length Hc in the conveying direction AR of the 2-pass partial images SA7 and SA8 at least a part of which are printed in the third holding state S3. As a result, by executing printing according to the holding state of the sheet S during printing, the image quality of the print image PA can be further improved.

The more detailed description will be made. In the second holding state S2, the sheet S is supported in a state where the sheet S is curved in the curved path VR (FIG. 5A). In the third holding state S3, the sheet S is not supported in a state where the sheet S is curved, that is, the sheet S is held in a substantially linear shape (FIG. 5B). Therefore, in the second holding state S2, the distance ΔL between the sheet S and the print head 110 is not stable as compared to the third holding state S3. Therefore, during printing in the second holding state S2, the above-described density unevenness is likely to occur in the 2-pass partial image. On the other hand, during printing in the third holding state S3, the above-described density unevenness is not likely to occur in the 2-pass partial image. Therefore, it is preferable that a difference in density between the 2-pass partial image and the 1-pass partial image is small. Therefore, it is preferable that the length in the conveying direction of the 2-pass partial image is long during printing in the third holding state S3. According to the example, the length Hb in the conveying direction AR of the 2-pass partial images SA4 to SA6 that are printed in the second holding state S2 is shorter than the length Hc in the conveying direction AR of the 2-pass partial images SA7 and SA8 at least a part of which are printed in the third holding state S3. As a result, the difference in density between the 2-pass partial image and the 1-pass partial image and the density unevenness in the 2-pass partial image can be more appropriately suppressed according to the holding state of the sheet S during printing.

In the example, the first holding state S1 and the third holding state S3 have the same stability of the distance ΔL between the sheet S and the print head 110. Therefore, in the example, the length Ha in the conveying direction AR of the 2-pass partial image SA2 that is printed in the first holding state S1 is equal to the length Ha in the conveying direction AR of the 2-pass partial images that is printed in the third holding state S3. As a result, the difference in density between the 2-pass partial image and the 1-pass partial image and the density unevenness in the 2-pass partial image can be more appropriately suppressed according to the holding state of the sheet S during printing.

In the example, the length Hd in the conveying direction AR of the 2-pass partial image SA9 at least a part of which is printed in the fourth holding state S4 is shorter than the length Ha in the conveying direction AR of the 2-pass partial image SA1 that is printed in the first holding state S1. As a result, the difference in density between the 2-pass partial image and the 1-pass partial image and the density unevenness in the 2-pass partial image can be more appropriately suppressed according to the holding state of the sheet S during printing.

The more detailed description will be made. In the fourth holding state S4, the sheet S is not held by the upstream roller pair 141, and thus the sheet S is conveyed only by the downstream roller pair 142. Therefore, in the fourth holding state S4, the conveyance amount of the sheet S is likely to vary as compared to the first holding state S1. On the other hand, in the fourth holding state S4, the sheet S is held only by the downstream roller pair 142. Therefore, as compared to the first holding state S1 the distance ΔL between the sheet S and the print head 110 is not stable. In the fourth holding state S4, whether the variation in the conveyance amount of the sheet S or the instability of the distance ΔL between the sheet S and the print head 110 is predominant is likely to vary depending on, for example, the structure of the conveyor 140 or the kind of the sheet S. For example, in a case where a spur is used in the downstream roller pair 142, the conveyance amount of the sheet S is likely to vary as compared to a case where a spur is not used in the downstream roller pair 142. In addition, as the distance between the upstream roller pair 141 and the downstream roller pair 142 increases as in a case where the nozzle length D is long, the distance ΔL between the sheet S and the print head 110 is not stable. In addition, as the rigidity of the sheet S decreases, the distance ΔL between the sheet S and the print head 110 is not stable. In the example, in the fourth holding state S4, the instability of the distance ΔL between the sheet S and the print head 110 is prominent as compared to the first holding state S1. In this case, density unevenness is not likely to occur in the 2-pass partial image. Therefore, it is preferable that the length in the conveying direction AR of the 2-pass partial image is short during printing in the fourth holding state S4. According to the example, the length Hd in the conveying direction AR of the 2-pass partial image SA9 at least a part of which is printed in the fourth holding state S4 is shorter than the length Ha in the conveying direction AR of the 2-pass partial image SA1 that is printed in the first holding state S1. As a result, the difference in density between the 2-pass partial image and the 1-pass partial image and the density unevenness in the 2-pass partial image can be more appropriately suppressed according to the holding state of the sheet S during printing.

In the example, in the fourth holding state S4, the distance ΔL between the sheet S and the print head 110 is not stable as compared to the second holding state S2. In the example, the length Hd in the conveying direction AR of the 2-pass partial image SA9 at least a part of which is printed in the fourth holding state S4 is shorter than the length Hb in the conveying direction AR of the 2-pass partial images SA4 to SA6 that is printed in the second holding state S2. As a result, the difference in density between the 2-pass partial image and the 1-pass partial image and the density unevenness in the 2-pass partial image can be more appropriately suppressed according to the holding state of the sheet S during printing.

As can be seen from the above description, in the example, the rollers 141*a* and 141*b* included in the upstream roller pair 141 are examples of the first roller, the rollers 142*a* and 142*b* included in the downstream roller pair 142 are examples of the second roller, and the pickup roller 143 is an example of the third roller. In addition, in the example, the 1-pass partial images NA1 to NA10 are examples of the first partial image, and the 2-pass partial images SA1 to SA9 are examples of the second partial image.

B. Second Example

Figure 12:
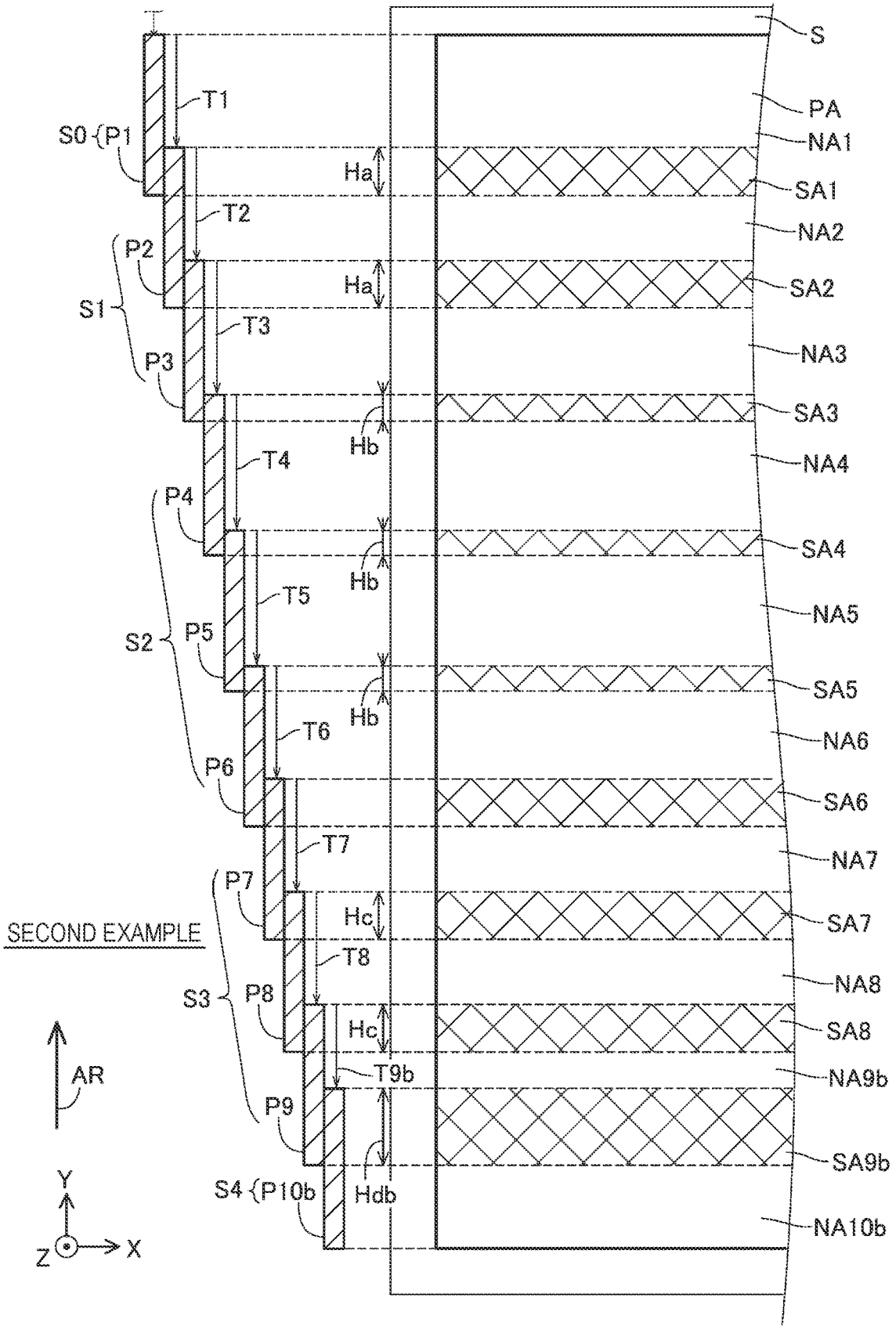
FIG. 12 is a diagram illustrating an example of a relationship between the sheet S and a head position P in a second example.

FIG. 12 is a diagram illustrating an example of a relationship between the sheet S and the head position P in a second example. In the second example, the conveyance amount of a ninth sheet conveying operation T9*b* is shorter than the conveyance amount of the sheet conveying operation T9 in the first example. As a result, a length Hdb in the conveying direction AR of a 2-pass partial image NA9*b* in the second example is longer than the length Hd in the conveying direction AR of the 2-pass partial image NA9 in the first example. In addition, the length in the conveying direction AR of 1-pass partial images NA9*b* and NA10*b* in the second example is shorter than the length in the conveying direction AR of the 1-pass partial images NA9 and NA10 in the first example. The other configurations of the second example are the same as those of the first example.

More specifically, in the second example, the length Hdb in the conveying direction AR of the 2-pass partial image NA9*b* at least a part of which is printed in the fourth holding state S4 is longer than the length Ha of the 2-pass partial image NA2 that is printed in the first holding state S1 (Hdb>Ha).

The more detailed description will be made. As described above, in the fourth holding state S4, the sheet S is not held by the upstream roller pair 141, and thus the sheet S is conveyed only by the downstream roller pair 142. Therefore, in the fourth holding state S4, the conveyance amount of the sheet S is likely to vary as compared to the first holding state S1. On the other hand, in the fourth holding state S4, the sheet S is held only by the downstream roller pair 142. Therefore, as compared to the first holding state S1 the distance ΔL between the sheet S and the print head 110 is not stable. In the fourth holding state S4, whether the variation in the conveyance amount of the sheet S or the instability of the distance ΔL between the sheet S and the print head 110 is predominant is likely to vary depending on, for example, the structure of the conveyor 140 or the kind of the sheet S. In the example, in the fourth holding state S4, a variation in the conveyance amount of the sheet S is predominant as compared to the first holding state S1. In this case, a difference in density between the 2-pass partial image and the 1-pass partial image is likely to occur. Therefore, it is preferable that the length in the conveying direction AR of the 2-pass partial image is long during printing in the fourth holding state S4. According to the example, the length Hdb in the conveying direction AR of the 2-pass partial image NA9*b* at least a part of which is printed in the fourth holding state S4 is longer than the length Ha of the 2-pass partial image NA2 that is printed in the first holding state S1. As a result, the difference in density between the 2-pass partial image and the 1-pass partial image and the density unevenness in the 2-pass partial image can be more appropriately suppressed according to the holding state of the print medium during printing.

C. Modification Example (1) In each of the examples, the length Hb in the conveying direction AR of the 2-pass partial images SA4 to SA6 that are printed in the second holding state S2 is shorter than the length Hc in the conveying direction AR of the 2-pass partial images SA7 and SA8 at least a part of which are printed in the third holding state S3. Instead, the length Hb in the conveying direction AR of the 2-pass partial images SA4 to SA6 may be longer than or equal to the length Hc in the conveying direction AR of the 2-pass partial images SA7 and SA8.

(2) In each of the examples, the length Hb in the conveying direction AR of the 2-pass partial image SA2 that is printed in the first holding state S1 is shorter than the length Hc in the conveying direction AR of the 2-pass partial images SA7 and SA8 at least a part of which are printed in the third holding state S3. Instead, the length Ha in the conveying direction AR of the 2-pass partial image SA2 may be longer than or may be shorter than the length Hc in the conveying direction AR of the 2-pass partial images SA7 and SA8.

(3) In the first example, the length Hd in the conveying direction AR of the 2-pass partial image SA9 at least a part of which is printed in the fourth holding state S4 is shorter than the length Ha in the conveying direction AR of the 2-pass partial image SA2 that is printed in the first holding state S1. Instead, the length Hd in the conveying direction AR of the 2-pass partial image SA9 may be equal to the length Ha in the conveying direction AR of the 2-pass partial image SA2.

(4) In the conveying path TR according to each of the examples, the pickup roller 143 is disposed upstream of the curved path VR. Instead, in the conveying path TR, for example, a roller pair (for example, a driving roller and a driven roller) that conveys the sheet S may be disposed upstream of the curved path VR. In this case, in the first holding state S1, for example, the sheet S is held by the upstream roller pair 141, is held by the downstream roller pair 142, and is held by the roller pair provided upstream of the curved path VR. In the second holding state S2, for example, the sheet S is held by the upstream roller pair 141, is held by the downstream roller pair 142, and is held by the roller pair provided upstream of the curved path VR.

(5) As the print media, other media such as, a film for OHP, CD-ROM, or DVD-ROM may be adopted instead of the sheet S.

(6) In the example, the printing mechanism 100 is a serial printer that includes the main scanning unit 130 and in which the print head 240 is driven to execute the partial printing operation during the main scanning operation. Instead, the printing mechanism 100 may be a line printer that does not include the main scanning unit 130 and includes a print head along a direction perpendicular to the conveying direction, the print head having a structure in which a plurality of nozzles are arranged in the conveying direction over the length that is substantially the same as the width of the sheet S. In the line printer, printing is executed without executing the main scanning operation. Even in this case, printing may be executed by alternately executing the partial printing operation of forming a dot using the print head and the sheet conveying operation of conveying the sheet S using the conveyor.

(7) In each of the examples, a device that functions as the control device for causing the printing mechanism 100 as the printing execution unit to execute the printing process of FIG. 7 is the CPU 210. Instead, the device that functions as the control device may be another kind of device, for example, a terminal device (not illustrated) of the user. In this case, for example, the terminal device operates as a printer driver by executing a driver program, and controls the printer as the printing execution unit that is a part of the functions of the printer driver such that the printing process of FIG. 7 is executed. In this case, the terminal device supplies a print job generated using the print image data to the printer so as to cause the printer to execute the printing process.

As can be understood from the above description, in the examples, the printing mechanism 100 is an example of the printing execution unit, and in a case where the terminal device executes the printing process, the entire printer that executes printing is an example of the printing execution unit.

In addition, the control device that causes the printer to execute the printing process of FIG. 7 may be, for example, a server that acquires image data from the printer or the terminal device and generates a print job using the image data. This server may be a plurality of calculators that can communicate with each other through the network. In this case, the calculators as a whole that can communicate with each other through the network are an example of the control device.

(12) In each of the examples, some of the configurations that are realized by hardware may be replaced with software. Conversely, some or all of the configurations that are realized by software may be replaced with hardware. For example, some of the processes that are executed by the CPU 210 of the printer 200 of FIG. 1 may be realized by a dedicated hardware circuit.

Hereinabove, the present invention has been described based on the examples and the modification examples. However, the above-described embodiments are provided to easily understand the present invention and do not limit the present invention. Changes and modifications can be made in the present invention within a range not departing from the scope of the claims, and equivalents thereof are included in the present invention.

What is claimed is:

1. A control device that controls a printing execution unit including: a print head including a plurality of nozzles from which ink is ejected; a head driver configured to cause the print head to eject ink and to form a dot on a print medium; and a conveyor to convey the print medium along a conveying path, to execute printing by alternately executing partial printings, which forms the dot using the print head, and print medium conveying, which conveys the print medium using the conveyor, the conveyor including:

a first roller provided upstream of the print head in the conveying path to hold the print medium;

a second roller provided downstream of the print head in the conveying path to hold the print medium; and a third roller provided upstream of the first roller in the conveying path to hold the print medium, the conveying path including a curved path that is provided between the first roller and the third roller and is curved when seen from a direction perpendicular to a conveying direction of the print medium and parallel to a printing surface of the print medium to be conveyed, the control device comprising:

a print controller to perform:

acquiring print image data representing a print image;

causing the printing execution unit to execute the partial printing m times by using the print image data so as to print the print image on the print medium, wherein the print image alternately includes a first partial image that is printed in an n-th partial printing and a second partial image that is printed in the n-th partial printing and an (n+1)-th partial printing, and wherein m represents an integer of 3 or more and n represents an integer of 1 or more and less than m, wherein a first holding state is a state where the print medium is held by the first roller, is held by the second roller, and is held by the third roller, a second holding state is a state where the print medium is held by the first roller, is held by the second roller, and is not held by the third roller, and a first length, in the conveying direction, of the second partial image that is printed in the first holding state is longer than a second length, in the conveying direction, of the second partial image in which at least a part is printed in the second holding state.

2. The control device according to claim 1, wherein the conveyor further includes a guide member that supports the print medium from one surface side in a state where the print medium is curved in the curved path, the second holding state is a state where the print medium is held by the first roller, is held by the second roller, is not held by the third roller, and is supported by the guide member, a third holding state is a state where the print medium is held by the first roller, is held by the second roller, is not held by the third roller, and is not supported by the guide member, and the second length, in the conveying direction, of the second partial image that is printed in the second holding state is shorter than a third length, in the conveying direction, of the second partial image in which at least a part is printed in the third holding state.

3. The control device according to claim 2, wherein the first length, in the conveying direction, of the second partial image that is printed in the first holding state is equal to the third length, in the conveying direction, of the second partial image in which at least a part is printed in the third holding state.

4. The control device according to claim 1, wherein a fourth holding state is a state where the print medium is not held by the first roller, is held by the second roller, and is not held by the third roller, a fourth length, in the conveying direction, of the second partial image in which at least a part is printed in the fourth holding state is shorter than the first length, in the conveying direction, of the second partial image that is printed in the first holding state.

5. The control device according to claim 4, wherein the fourth length, in the conveying direction, of the second partial image in which at least a part is printed in the fourth holding state is shorter than the second length, in the conveying direction, of the second partial image that is printed in the second holding state.

6. The control device according to claim 1, wherein a fourth holding state is a state where the print medium is not held by the first roller, is held by the second roller, and is not held by the third roller, and a fourth length, in the conveying direction, of the second partial image in which at least a part is printed in the fourth holding state is longer than the first length, in the conveying direction, of the second partial image that is printed in the first holding state.

7. The control device according to claim 1, wherein the printing execution unit further includes a main scanning unit that executes main scanning of moving the print head along a main scanning direction, and the head driver cause the print head to form the dot on the print medium during the main scanning to execute the partial printing.

8. The control device according to claim 1, wherein the printing execution unit further includes a tray where a plurality of print media overlap each other and are accommodated, and the third roller is a pickup roller that separates one print medium from the print media accommodated in the tray and supplies the separated print medium to the conveying path.

9. A printing device comprising:

the control device according to claim 1; and the printing execution unit.

10. A non-transitory computer-readable medium having instructions to control a printing execution unit including: a print head including a plurality of nozzles from which ink is ejected; a head driver configured to cause the print head to eject ink to form a dot on a print medium; and a conveyor to convey the print medium along a conveying path, to execute printing by alternately executing partial printings, which forms the dot using the print head, and print medium conveying, which conveys the print medium using the conveyor, the conveyor including:

a first roller provided upstream of the print head in the conveying path to hold the print medium;

a second roller provided downstream of the print head in the conveying path and holds the print medium; and a third roller provided upstream of the first roller in the conveying path to hold the print medium, the conveying path including a curved path that is provided between the first roller and the third roller and is curved when seen from a direction perpendicular to a conveying direction of the print medium and parallel to a printing surface of the print medium to be conveyed, the instructions to control the printing execution unit to perform:

acquiring print image data representing a print image; and executing the partial printings m times by using the print image data so as to print the print image on the print medium, wherein the print image alternately includes a first partial image that is printed in an n-th partial printing and a second partial image that is printed in the n-th partial printing and an (n+1)-th partial printing, and wherein m represents an integer of 3 or more and n represents an integer of 1 or more and less than m, wherein a first holding state is a state where the print medium is held by the first roller, is held by the second roller, and is held by the third roller, a second holding state is a state where the print medium is held by the first roller, is held by the second roller, and is not held by the third roller, and a first length, in the conveying direction, of the second partial image that is printed in the first holding state is longer than a second length, in the conveying direction, of the second partial image in which at least a part is printed in the second holding state.

11. The non-transitory computer-readable medium having instructions according to claim 10, wherein the conveyor further includes a guide member that supports the print medium from one surface side in a state where the print medium is curved in the curved path, the second holding state is a state where the print medium is held by the first roller, is held by the second roller, is not held by the third roller, and is supported by the guide member, a third holding state is a state where the print medium is held by the first roller, is held by the second roller, is not held by the third roller, and is not supported by the guide member, and the second length, in the conveying direction, of the second partial image that is printed in the second holding state is shorter than a third length, in the conveying direction, of the second partial image in which at least a part is printed in the third holding state.

12. The non-transitory computer-readable medium having instructions according to claim 11, wherein the first length, in the conveying direction, of the second partial image that is printed in the first holding state is equal to the third length, in the conveying direction, of the second partial image in which at least a part is printed in the third holding state.

13. The non-transitory computer-readable medium having instructions according to claim 10, wherein a fourth holding state is a state where the print medium is not held by the first roller, is held by the second roller, and is not held by the third roller, a fourth length, in the conveying direction, of the second partial image in which at least a part is printed in the fourth holding state is shorter than the first length, in the conveying direction, of the second partial image that is printed in the first holding state.

14. The non-transitory computer-readable medium having instructions according to claim 13, wherein the fourth length, in the conveying direction, of the second partial image in which at least a part is printed in the fourth holding state is shorter than the second length, in the conveying direction, of the second partial image that is printed in the second holding state.

15. The non-transitory computer-readable medium having instructions according to claim 10, wherein a fourth holding state is a state where the print medium is not held by the first roller, is held by the second roller, and is not held by the third roller, and a fourth length, in the conveying direction, of the second partial image in which at least a part is printed in the fourth holding state is longer than the first length, in the conveying direction, of the second partial image that is printed in the first holding state.

16. The non-transitory computer-readable medium having instructions according to claim 10, wherein the printing execution unit further includes a main scanning unit that executes main scanning of moving the print head along a main scanning direction, and the head driver forms the dot on the print head during the main scanning and executes the partial printing.

17. The non-transitory computer-readable medium having instructions according to claim 10, wherein the printing execution unit further includes a tray where a plurality of print media overlap each other and are accommodated, and the third roller is a pickup roller that separates one print medium from the print media accommodated in the tray and supplies the separated print medium to the conveying path.

18. A method of controlling a printing execution unit including: a print head including a plurality of nozzles from which ink is ejected; a head driver configured to cause the print head to eject ink to form a dot on a print medium; and a conveyor to convey the print medium along a conveying path, to execute printing by alternately executing partial printings, which forms the dot using the print head, and print medium conveying, which conveys the print medium using the conveyor, the conveyor including:

a first roller provided upstream of the print head in the conveying path to hold the print medium;

a second roller provided downstream of the print head in the conveying path to hold the print medium; and a third roller provided upstream of the first roller in the conveying path to hold the print medium, the conveying path including a curved path that is provided between the first roller and the third roller and is curved when seen from a direction perpendicular to a conveying direction and parallel to a printing surface of the print medium to be conveyed, the method comprising:

acquiring print image data representing a print image; and executing the partial printings m times by using the print image data so as to print the print image on the print medium, wherein the print image alternately includes a first partial image that is printed in an n-th partial printing and a second partial image that is printed in the n-th partial printing and an (n+1)-th partial printing, and wherein m represents an integer of 3 or more and n represents an integer of 1 or more and less than m, wherein a first holding state is a state where the print medium is held by the first roller, is held by the second roller, and is held by the third roller, a second holding state is a state where the print medium is held by the first roller, is held by the second roller, and is not held by the third roller, and a first length, in the conveying direction, of the second partial image that is printed in the first holding state is longer than a second length, in the conveying direction, of the second partial image in which at least a part is printed in the second holding state.

* * * * *